US011897689B2

(12) United States Patent
Pai et al.

(10) Patent No.: US 11,897,689 B2
(45) Date of Patent: Feb. 13, 2024

(54) UNIVERSAL ROBOTIC-ENABLED STORAGE AND RETRIEVAL SYSTEM

(71) Applicant: Intelligrated Headquarters, LLC, Mason, OH (US)

(72) Inventors: Ramdas M Pai, Cary, NC (US); Tak Keung Joseph Lui, Mason, OH (US); Sai Prasanth Krishnamoorthy, Pittsburgh, PA (US)

(73) Assignee: Intelligrated Headquarters, LLC, Mason, OH (US)

( * ) Notice: Subject to any disclaimer, the term of this patent is extended or adjusted under 35 U.S.C. 154(b) by 26 days.

(21) Appl. No.: 17/508,774

(22) Filed: Oct. 22, 2021

(65) Prior Publication Data

US 2022/0127073 A1 Apr. 28, 2022

Related U.S. Application Data

(60) Provisional application No. 63/105,690, filed on Oct. 26, 2020.

(51) Int. Cl.

| | |
|---|---|
| ***B65D 88/74*** | (2006.01) |
| ***B65D 81/18*** | (2006.01) |
| ***F25B 21/04*** | (2006.01) |

(52) U.S. Cl.

CPC ..... *B65D 88/744* (2013.01); *B65D 81/18* (2013.01); *B65D 88/747* (2013.01); *F25B 21/04* (2013.01);

(Continued)

(58) Field of Classification Search

CPC .... B65D 88/744; B65D 81/18; B65D 88/747; F25B 21/04; F25B 2321/0212;

(Continued)

(56) References Cited

U.S. PATENT DOCUMENTS

2019/0323756 A1* 10/2019 Alexander ..... F25B 21/02
2020/0248935 A1* 8/2020 Born ..... F25D 11/02

(Continued)

FOREIGN PATENT DOCUMENTS

WO 2019/071112 A1 4/2019

OTHER PUBLICATIONS

European search report dated Mar. 2, 2022 for EP Application No. 21204810.

(Continued)

*Primary Examiner* — Elizabeth J Martin
(74) *Attorney, Agent, or Firm* — Alston & Bird LLP

(57) ABSTRACT

The present application discloses temperature regulated apparatuses, methods, and computer program products for temperature regulated containers. An example temperature regulated apparatus includes a base container. The base container includes at least a base portion, one or more sidewall portions, and a lid portion. The example temperature regulated apparatus also includes one or more thermoelectric components, where (i) each of the one or more thermoelectric components are configured to be disposed within the interior of the base container, (ii) each thermoelectric component comprises an exterior surface, an interior surface, and a composite semiconductor layer disposed between the exterior surface and the interior surface, and (iii) each thermoelectric component is configured to, in an instance current flows through the thermoelectric component, transfer heat between the interior surface and exterior surface.

17 Claims, 8 Drawing Sheets

(52) U.S. Cl.
CPC ... *F25B 2321/023* (2013.01); *F25B 2321/025* (2013.01); *F25B 2321/0212* (2013.01); *F25D 2700/123* (2013.01)

(58) Field of Classification Search
CPC ..... F25B 2321/023; F25B 2321/025; F25B 2700/123; F25D 11/00
See application file for complete search history.

(56) References Cited

U.S. PATENT DOCUMENTS

| | | | |
|---|---|---|---|
| 2021/0063062 | A1 | 3/2021 | Alexander et al. |
| 2021/0199353 | A1 | 7/2021 | Edwards et al. |

OTHER PUBLICATIONS https://mwpvl.com/html/grocery_automation.html.
https://www.mmh.com/article/micro_fulfillment_may_be_coming_to_a_grocery_store_near_you.

* cited by examiner

UNIVERSAL ROBOTIC-ENABLED STORAGE AND RETRIEVAL SYSTEM

CROSS-REFERENCES TO RELATED APPLICATION(S)

The present application claims priority to U.S. Provisional Patent Application No. 63/105,690 (filed Oct. 26, 2020), which is incorporated herein by reference in its entirety.

TECHNICAL FIELD

The present application relates generally to a universal robotic-enabled storage and retrieval system that is designed to operate in a wide range of temperatures in a limited amount of space.

BRIEF SUMMARY

Various embodiments described herein relate to methods, apparatuses, and systems for operation of a storage and retrieval system configured to operate in a wide range of temperatures.

In accordance with various examples of the present disclosure, a temperature regulated apparatus is provided. The apparatus may include a base container, wherein the base container includes at least: a base portion and wherein the base portion, one or more sidewall portions, wherein the one or more sidewall portions are integrated with an interior surface of the base portion, and a lid portion, wherein the lid portion is configured to attach to the one or more sidewall portions, and wherein the base container defines an interior portion defined by at least the base portion, one or more sidewall portions, and the lid portion. The temperature regulated apparatus may also include one or more thermoelectric components, wherein (i) each of the one or more thermoelectric components are configured to be disposed within the interior of the base container, (ii) each thermoelectric component comprises an exterior surface, an interior surface, and a composite semiconductor layer disposed between the exterior surface and interior surface, and (iii) each thermoelectric component is configured to, in an instance current flows through the thermoelectric component, transfer heat between the interior surface and exterior surface.

In some embodiments, the one or more thermoelectric components are configured to be disposed along the base portion, one or more sidewall portions, or lid portion of the base container.

In some embodiments, the temperature regulated apparatus further includes an inductive charging grid. In some embodiments, the inductive charging grid is integrated within the base container, and the inductive charging grid is configured to induce a current within the one or more thermoelectric components.

In some embodiments, the inductive charging grid may comprise one or more inductive charging grid sections, wherein each inductive charging grid section is configured to provide a current to the one or more thermoelectric components within a portion of the base container.

In some embodiments, the inductive charging grid is configured to be powered using one or more batteries.

In some embodiments, the temperature regulated apparatus further includes one or more sensors, wherein the one or more sensors may be configured to measure at least one of a temperature or humidity of the interior portion of the base container.

In some embodiments, the base container further includes one or more louvre sets. In some embodiments, each louvre set includes one or more louvres configured to actuate as a unit, each louvre set is configured to move between an open configuration and a closed configuration, and in an instance a louvre set is not in the closed configuration, air may flow between the interior portion of the base container and a surrounding external environment of the base container.

In some embodiments, the temperature regulated apparatus further includes a controller, wherein the controller is configured to perform one or more operational tasks and wherein the controller is in communication with at least one or more sensors and an inductive charging grid. In some embodiments, the one or more operational tasks include actuating one or more louvre sets between one or more configurations, activating one or more inductive charging grid sections of the inductive charging grid, or providing one or more warning data objects to one or more user devices in an instance one or more trigger events occur.

In some embodiments, the one or more trigger events include determination that one or more temperature values do not satisfy one or more temperature threshold values, one or more humidity values do not satisfy one or more humidity threshold values, or a maintenance time duration satisfies one or more maintenance time durations.

In some embodiments, two or more of the one or more thermoelectric components are stacked adjacent to one or another such that the interior surface of one thermoelectric component is adjacent to the exterior surface of another thermoelectric component.

In accordance with various examples of the present disclosure, method is provided. The method may include measuring, using one or more sensors, a temperature value within a temperature regulated container. The method may further include determining whether the measured temperature value satisfies one or more temperature threshold values. The method may further include in an instance the measured temperature value does not satisfy one or more temperature threshold values, activating one or more inductive charging grid sections of an inductive charging grid.

In some embodiments, the method further includes measuring, using the one or more sensors, a temperature value within the temperature regulated container after a duration of time since activation of the one or more inductive charging grid sections. In some embodiments, the method further includes determining whether the measured temperature value satisfies one or more temperature threshold values. In some embodiments, the method further includes, in an instance the measured temperature value does not satisfy one or more temperature threshold values, maintaining activation of the one or more inductive charging grid sections of the inductive charging grid. In some embodiments, the method further includes in an instance the measured temperature value satisfies one or more temperature threshold values, deactivating one or more inductive charging grid sections of the inductive charging grid.

In some embodiments, the method further includes, in an instance the measured temperature value does not satisfy one or more temperature threshold values, actuating one or more louvre sets between one or more configurations.

In some embodiments, the method further includes measuring, using the one or more sensors, a humidity value within a temperature regulated container. In some embodiments, the method further includes determining whether the measured humidity value satisfies one or more humidity threshold values. In some embodiments, the method further includes, in an instance the measured humidity value does not satisfy one or more humidity threshold values, actuating one or more louvre sets between one or more configurations.

In some embodiments, the method further includes providing one or more warning data objects to one or more user devices in an instance one or more trigger events occur.

In some embodiments, the one or more trigger events include determination that one or more temperature values do not satisfy one or more temperature threshold values, one or more humidity values do not satisfy one or more humidity threshold values, or a maintenance time duration satisfies one or more maintenance time durations.

In accordance with various examples of the present disclosure, an apparatus is provided with at least one processing component. The at least one processing component of the apparatus may be configured to measure, using one or more sensors, a temperature value within a temperature regulated container. The at least one processing component of the apparatus may further be configured to determine whether the measured temperature value satisfies one or more temperature threshold values The at least one processing component of the apparatus may further be configured to, in an instance the measured temperature value does not satisfy one or more temperature threshold values, activate one or more inductive charging grid sections of an inductive charging grid.

In some embodiments, the at least one processing component of the apparatus may further be configured measure, using the one or more sensors, a temperature value within the temperature regulated container after a duration of time since activation of the one or more inductive charging grid sections. In some embodiments, the at least one processing component of the apparatus may further be configured to determine whether the measured temperature value satisfies one or more temperature threshold values. In some embodiments, the at least one processing component of the apparatus may further be configured, in an instance the measured temperature value does not satisfy one or more temperature threshold values, maintain activation of the one or more inductive charging grid sections of the inductive charging grid. In some embodiments, the at least one processing component of the apparatus may further be configured, in an instance the measured temperature value satisfies one or more temperature threshold values, deactivate one or more inductive charging grid sections of the inductive charging grid.

In some embodiments, the at least one processing component of the apparatus may further be configured, in an instance the measured temperature value does not satisfy one or more temperature threshold values, actuate one or more louvre sets between one or more configurations.

In some embodiments, the at least one processing component of the apparatus may further be configured to measure, using the one or more sensors, a humidity value within a temperature regulated container. In some embodiments, the at least one processing component of the apparatus may further be configured to determine whether the measured humidity value satisfies one or more humidity threshold values. In some embodiments, the at least one processing component of the apparatus may further be configured to, in an instance the measured humidity value does not satisfy one or more humidity threshold values, actuate one or more louvre sets between one or more configurations.

In some embodiments, the at least one processing component of the apparatus may further be configured to provide one or more warning data objects to one or more user devices in an instance one or more trigger events occur.

In some embodiments, the one or more trigger events include determination that one or more temperature values do not satisfy one or more temperature threshold values, one or more humidity values do not satisfy one or more humidity threshold values, or a maintenance time duration satisfies one or more maintenance time durations.

In accordance with various examples of the present disclosure, a computer program product is provided, the computer program product comprising at least one non-transitory computer-readable storage medium having computer-readable program code portions stored therein, the computer-readable program code portions configured, upon execution, to measure, using one or more sensors, a temperature value within a temperature regulated container. The computer-readable program code portions may further be configured, upon execution, to determine whether the measured temperature value satisfies one or more temperature threshold values The computer-readable program code portions may further be configured, upon execution, to, in an instance the measured temperature value does not satisfy one or more temperature threshold values, activate one or more inductive charging grid sections of an inductive charging grid.

In some embodiments, the computer-readable program code portions may further be configured, upon execution, to measure, using the one or more sensors, a temperature value within the temperature regulated container after a duration of time since activation of the one or more inductive charging grid sections. In some embodiments, the computer-readable program code portions may further be configured, upon execution, to determine whether the measured temperature value satisfies one or more temperature threshold values. In some embodiments, the computer-readable program code portions may further be configured, upon execution, to, in an instance the measured temperature value does not satisfy one or more temperature threshold values, maintain activation of the one or more inductive charging grid sections of the inductive charging grid. In some embodiments, the computer-readable program code portions may further be configured, upon execution, to, in an instance the measured temperature value satisfies one or more temperature threshold values, deactivate one or more inductive charging grid sections of the inductive charging grid.

In some embodiments, the computer-readable program code portions may further be configured, upon execution, to, in an instance the measured temperature value does not satisfy one or more temperature threshold values, actuate one or more louvre sets between one or more configurations.

In some embodiments, the computer-readable program code portions may further be configured, upon execution, to measure, using the one or more sensors, a humidity value within a temperature regulated container. In some embodiments, the computer-readable program code portions may further be configured, upon execution, to determine whether the measured humidity value satisfies one or more humidity threshold values. In some embodiments, the computer-readable program code portions may further be configured, upon execution, to, in an instance the measured humidity value does not satisfy one or more humidity threshold values, actuate one or more louvre sets between one or more configurations.

In some embodiments, the computer-readable program code portions may further be configured, upon execution, to provide one or more warning data objects to one or more user devices in an instance one or more trigger events occur.

In some embodiments, the one or more trigger events include determination that one or more temperature values do not satisfy one or more temperature threshold values, one or more humidity values do not satisfy one or more humidity threshold values, or a maintenance time duration satisfies one or more maintenance time durations.

In accordance with various examples of the present disclosure, another method is provided. The method includes determining, using a main controller comprising one or more processors and in response to one or more movement trigger events, to update a placement location of one or more temperature regulated containers within a structure of a storage and retrieval system. In some embodiments, the method further includes providing, using the main controller, routing instructions to a robotic device to facilitate movement of the one or more temperature regulated containers to the one or more updated locations.

In some embodiments, the method further includes measuring, using one or more sensors, a temperature value corresponding to a location range of the storage and retrieval system. In some embodiments, the method further includes determining whether the measured temperature value satisfies one or more temperature threshold values. In some embodiments, the method further includes, in an instance the measured temperature value does not satisfy one or more temperature threshold values, determining a movement trigger event.

In some embodiments, the one or more movement trigger events may be determined based at least in part on an item demand frequency or temperature regulated container frequency.

In accordance with various examples of the present disclosure, another apparatus is provided with at least one processing component. The at least one processing component of the apparatus may be configured to determine, in response to one or more movement trigger events, update a placement location of one or more temperature regulated containers within a structure of a storage and retrieval system. In some embodiments, the at least one processing component of the apparatus may further be configured to provide routing instructions to a robotic device to facilitate movement of the one or more temperature regulated containers to the one or more updated locations.

In some embodiments, the at least one processing component of the apparatus may further be configured to measure, using one or more sensors, a temperature value corresponding to a location range of the storage and retrieval system. In some embodiments, the at least one processing component of the apparatus may further be configured to determine whether the measured temperature value satisfies one or more temperature threshold values. In some embodiments, the at least one processing component of the apparatus may further be configured to, in an instance the measured temperature value does not satisfy one or more temperature threshold values, determine a movement trigger event.

In some embodiments, the one or more movement trigger events may be determined based at least in part on an item demand frequency or temperature regulated container frequency.

In accordance with various examples of the present disclosure, another computer program product is provided, The computer program product comprising at least one non-transitory computer-readable storage medium having computer-readable program code portions stored therein, the computer-readable program code portions configured, upon execution, to determine, in response to one or more movement trigger events, update a placement location of one or more temperature regulated containers within a structure of a storage and retrieval system. In some embodiments, the computer-readable program code portions are further configured, upon execution, to provide routing instructions to a robotic device to facilitate movement of the one or more temperature regulated containers to the one or more updated locations.

In some embodiments, the computer-readable program code portions are further configured, upon execution, to measure, using one or more sensors, a temperature value corresponding to a location range of the storage and retrieval system. the computer-readable program code portions are further configured, upon execution, to determine whether the measured temperature value satisfies one or more temperature threshold values. the computer-readable program code portions are further configured, upon execution, to, in an instance the measured temperature value does not satisfy one or more temperature threshold values, determine a movement trigger event.

In some embodiments, the one or more movement trigger events may be determined based at least in part on an item demand frequency or temperature regulated container frequency.

In accordance with various examples of the present disclosure, a storage and retrieval system is provided. The storage and retrieval system may include one or more temperature regulated containers configured to maintain a predefined temperature range. The storage and retrieval system may further include one or more robotic devices configured to move the temperature regulated container within a structure of the universal robotic-enabled storage and retrieval system. The storage and retrieval system may further include a controller that is configured to at least adjust the predefined temperature range and provide routing instructions to the robotic device.

In some embodiments, the predefined temperature range is based at least in part on one or more items which are housed within the temperature regulated container. In some embodiments, the controller provides one or more instructions to the robotic device to position the temperature regulated container within the universal robotic-enabled storage and retrieval system based at least in part on at least one of a product velocity and reducing robotic device travel distance.

In some embodiments, the storage and retrieval system further includes one or more sensors are configured to monitor at least a temperature or humidity at one or more locations within the storage and retrieval system.

In some embodiments, the temperature regulated container may include a base container, wherein the base container includes at least: a base portion and wherein the base portion, one or more sidewall portions, wherein the one or more sidewall portions are integrated with an interior surface of the base portion, and a lid portion, wherein the lid portion is configured to attach to the one or more sidewall portions, and wherein the base container defines an interior portion defined by at least the base portion, one or more sidewall portions, and the lid portion. The temperature regulated container may also include one or more thermoelectric components, wherein (i) each of the one or more thermoelectric components are configured to be disposed within the interior of the base container, (ii) each thermoelectric component comprises an exterior surface, an interior surface, and a composite semiconductor layer disposed between the exterior surface and interior surface, and (iii) each thermoelectric component is configured to, in an instance current flows through the thermoelectric component, transfer heat between the interior surface and exterior surface.

In some embodiments, the one or more thermoelectric components are configured to be disposed along the base portion, one or more sidewall portions, or lid portion of the base container.

In some embodiments, the temperature regulated container further includes an inductive charging grid. In some embodiments, the inductive charging grid is integrated within the base container, and the inductive charging grid is configured to induce a current within the one or more thermoelectric components.

In some embodiments, the inductive charging grid may comprise one or more inductive charging grid sections, wherein each inductive charging grid section is configured to provide a current to the one or more thermoelectric components within a portion of the base container.

In some embodiments, the inductive charging grid is configured to be powered using one or more batteries.

In some embodiments, the temperature regulated container further includes one or more sensors, wherein the one or more sensors may be configured to measure at least one of a temperature or humidity of the interior portion of the base container.

In some embodiments, the base container further includes one or more louvre sets. In some embodiments, each louvre set includes one or more louvres configured to actuate as a unit, each louvre set is configured to move between an open configuration and a closed configuration, and in an instance a louvre set is not in the closed configuration, air may flow between the interior portion of the base container and a surrounding external environment of the base container.

In some embodiments, the temperature regulated container further includes a controller, wherein the controller is configured to perform one or more operational tasks and wherein the controller is in communication with at least one or more sensors and an inductive charging grid. In some embodiments, the one or more operational tasks include actuating one or more louvre sets between one or more configurations, activating one or more inductive charging grid sections of the inductive charging grid, or providing one or more warning data objects to one or more user devices in an instance one or more trigger events occur.

In some embodiments, the one or more trigger events include determination that one or more temperature values do not satisfy one or more temperature threshold values, one or more humidity values do not satisfy one or more humidity threshold values, or a maintenance time duration satisfies one or more maintenance time durations.

In some embodiments, two or more of the one or more thermoelectric components are stacked adjacent to one or another such that the interior surface of one thermoelectric component is adjacent to the exterior surface of another thermoelectric component.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
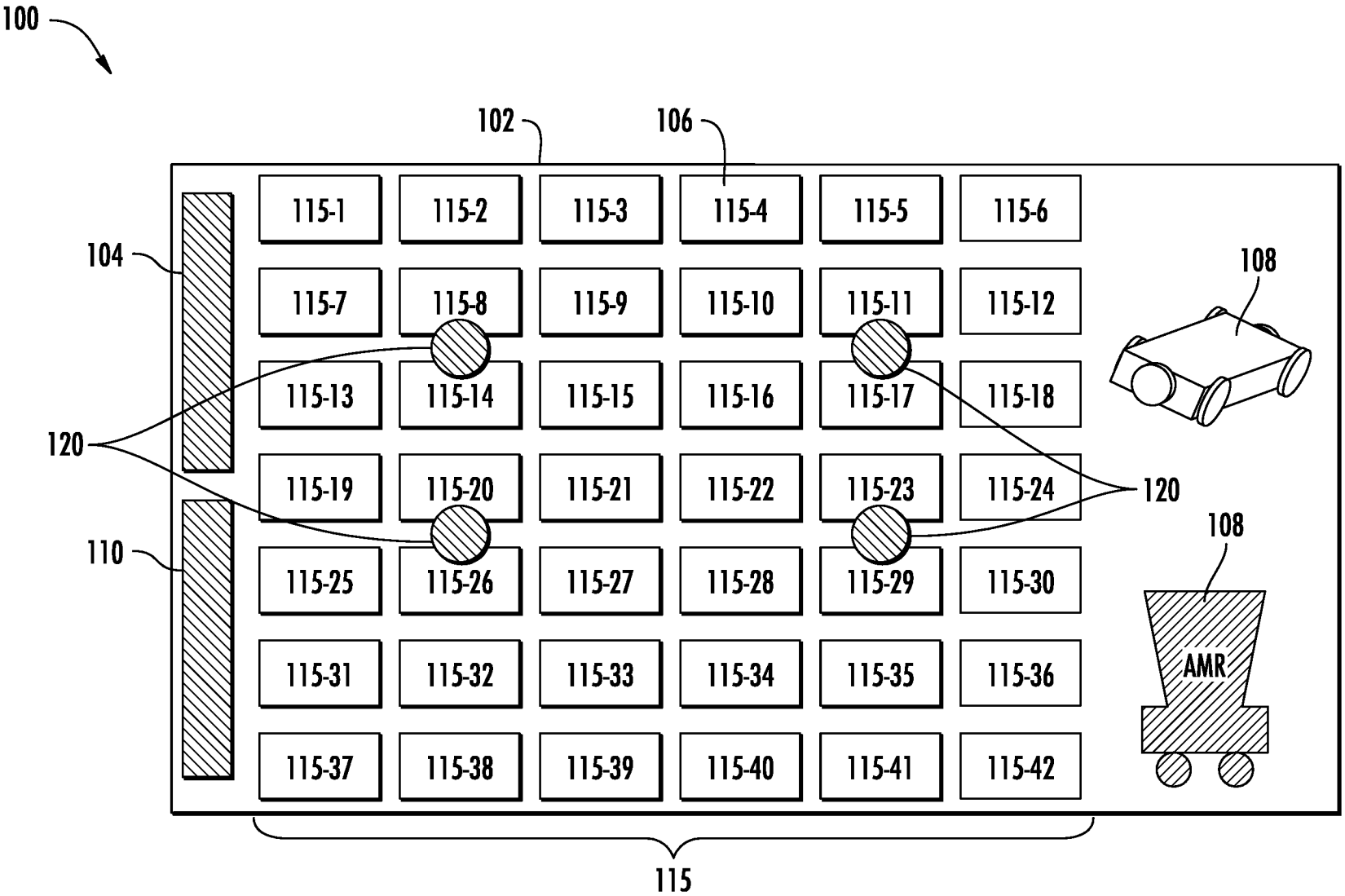
FIG. 1 illustrates an example embodiment of a storage and retrieval system in accordance with various aspects and embodiments of the subject disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout.

The components illustrated in the figures represent components that may or may not be present in various embodiments of the present disclosure described herein such that embodiments may include fewer or more components than those shown in the figures while not departing from the scope of the present disclosure. Some components may be omitted from one or more figures or shown in dashed line for visibility of the underlying components.

The phrases "in an example embodiment," "some embodiments," "various embodiments," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such components or features may be optionally included in some embodiments, or may be excluded.

The term "electronically coupled" or "in electronic communication with" in the present disclosure refer to two or more electrical elements (for example, but not limited to, a computational platform, predictive data analysis system, sensing unit, warehouse management system, and control unit) and/or electric circuit(s) being connected through wired means (for example but not limited to, conductive wires or traces) and/or wireless means (for example but not limited to, wireless network, electromagnetic field), such that data and/or information (for example, electronic indications, signals) may be transmitted to and/or received from the electrical elements and/or electric circuit(s) that are electronically coupled.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details.

Conventionally, items requiring temperature-controlled environments are placed in a bulk storage with one or more similar items requiring the same environmental temperature. For example, one or more items requiring an environmental temperature between 1 degree Celsius and 4 degrees Celsius may be placed within a refrigerated environment. As another example, one or more items requiring an environmental temperature below −18 degrees Celsius (° C.) may be placed within a freezer environment. Such temperature-controlled environments have conventionally encompassed a relatively large storage volume, which is used to store similar items together within the storage area (e.g., a freezer section, refrigerator section, etc.). However, maintaining the temperature of such a large storage volume may be costly and/or inefficient to maintain. Furthermore, the storage area may include one or more electronic components and/or mechanical components, which may be adversely affected due to the cooled temperature ranges. For example, the viscosity of lubricants used for various mechanical components within the storage area may increase, thereby decreasing the effectiveness of such lubricants and increasing the likelihood of mechanical component failure. As another example, condensation within such environments may interfere with the operation of one or more mechanical components and/or electronic components.

As such, it may be advantageous to store temperature-controlled items within individual temperature regulated containers. Rather than having dedicated refrigerated sections of the storage system, individual containers (e.g., trays, or totes) can be temperature regulated, to refrigerate or freeze the contents of the containers. Alternatively, the temperature regulated containers may be temperature regulated such that they may store warm and/or heated items as well. The containers can use thermoelectric components to maintain a variety of temperatures within the containers based on a predefined storage temperature of the items within the containers. Such temperature regulated containers may alleviate the need for bulk temperature-controlled storage sections by providing a storage space which is capable of effectively storing one or more temperature-controlled items at a desired temperature. Such temperature regulated containers may be configured to control and maintain a particular temperature range of an associated internal portion of a temperature regulated container using one or more thermoelectric components. Furthermore, in some embodiments, the one or more temperature regulated containers may be further configured to maintain one or more other environmental factors such as the humidity of the internal portion of the temperature regulated container. As such, the use of temperature regulated containers within a storage and retrieval system may allow for more efficient storage of temperature-controlled items and result in increase lifetimes for associated mechanical components and/or electrical components of the storage and retrieval system.

Furthermore, the storage of items within one or more temperature regulated containers and/or non-temperature regulated containers allows for the storage and retrieval system to more easily arrange and/or rearrange the containers within the storage area. For example, the containers may be arranged based on an associated item demand frequency, container demand frequency, and/or the like. In some embodiments, robotic devices can be configured to move and/or rearrange the containers within the storage system when items from the containers are to be picked or retrieved or based on thermal management of the storage system. The containers can also be moved by the robotic devices based on the product velocity or how often the containers need to be retrieved by the system due to picking or retrieval demands. In an embodiment, containers that are picked from often, or containers that have or will have a high demand, can be placed nearer the pick location or in a location that makes the containers more accessible and shorter routing time than containers that have lower product velocity or lower demand. As such, the storage and retrieval system may not restrict the arrangement of containers within the storage area based solely on temperature such that the storage and retrieval system may arrange and/or store containers and associated items more efficiently.

In an embodiment, some of the benefits of the storage and retrieval system of example embodiments include the modular design of the system which can reduce infrastructure complexity, standardized container design with identical temperature regulating unit reduces system maintenance cost. Another benefit is inherent redundancy. Freezer or refrigerator failure will lead to food spoilage of the entire inventory and complete system halt in a traditional design. For example, in the event of temperature regulation unit failure of one of the containers, the container temperature sensor can detect a change in temperature, the controller, based at least in part on a temperature regulating algorithm, can dispatch a robotic device to move the problematic temperature regulated container to, for example, a pick station for a complete product swap out.

Another benefit of the storage and retrieval system of example embodiments include providing space saving and infrastructure simplicity, lower infrastructure costs, and lower maintenance costs. The one or more thermoelectric components integrated into a temperature regulated container can eliminate the need for having three or more temperature zones (e.g., chilled, frozen and ambient) in, for example, a micro-fulfilment center. Different temperature regulated containers can be situated in any position in the storage and retrieval system. As such, available space can be utilized more effectively and flexibly. Furthermore, having a unified robotic device design allows for lower robot cost and/or lower robot maintenance cost and further, means that there is no need to design the robot to operate in different operating temperatures. Conventionally, the freezer zone is the most challenging operating environment for robotic devices due to the icy conditions. However, in provided embodiments, robotic devices need not operate directly in such environments and thus allowing for the mechanical components of robotic devices to accommodate a smaller range of contraction and expansion, thus saving on mechanical component cost.

Another benefit of the storage and retrieval system of example embodiments include energy saving. The system design eliminates the need for setting up dedicated temperature zones for a storage and retrieval system. Instead, a central ventilation system along with intelligent temperature algorithms may be used to centralize temperature regulation of distribution center, such as micro-fulfillment center, operation. Furthermore, the thermoelectric components used in the temperature regulated containers system provide for environmentally friendly cooling and/or heating operation as there is no Freon, pumps, condensers and no/low noise. Additionally, there is less food spoilage due to human errors as there are no human errors associated with in leaving food products outside the required temperature zones.

As used in this disclosure, in some embodiments, the terms "component," "system" and the like are intended to refer to, or comprise, a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, computer-executable instructions, a program, and/or a computer. By way of illustration and not limitation, both an application running on a server and the server can be a component.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. While various components have been illustrated as separate components, it will be appreciated that multiple components can be implemented as a single component, or a single component can be implemented as multiple components, without departing from example embodiments.

Further, the various embodiments can be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable (or machine-readable) device or computer-readable (or machine-readable) storage/communications media. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

Turning now to FIG. 1, illustrated is an example embodiment of a storage and retrieval system 100. In some embodiments, the storage and retrieval system 100 may be implemented within one or more locations, systems, and/or subsystems. For example, the storage and retrieval system 100 may be implemented within a distribution center, such as a micro-distribution center and/or pico-distribution center. As another example, the storage and retrieval system 100 may be implemented within an item distribution system, which may additionally include one or more subsystems, such as a robotic pick and place system, a robotic packaging and address printing system, and/or the like. In some embodiments, a distribution center may include one or more storage and retrieval systems within the distribution center. In some embodiments, the storage and retrieval system 100 may include one or more temperature regulated containers 106, one or more non-temperature regulated containers, a main controller 104, a communications component 110, one or more robotic devices 108, one or more sensors 120, and/or the like.

The storage and retrieval system 100 may include a storage area 102. The storage area 102 may comprise an array of containers 115 that may be defined by one or more bays, racks, shelves, and/or the like within the storage area 102. The array of containers 115 may further define one or more container locations 115-1 to 115-42 within the storage area 102. In some embodiments, each container location may be defined by a set of three-dimensional coordinates. For example, a container location may define an x, y, and z coordinate position relative to an initial position. An initial position may be defined anywhere within the storage area 102. In some embodiments, each container location may further define a container location volume, which may define the associated volume encompassed by the container location. Each container location may further be defined by a container location identifier, which may uniquely identify the container location from one or more other container locations within the storage area 102. The main controller 104 may be configured with the configuration of the array of containers 115 such that the main controller 104 may identify each container location within the storage area 102.

In some embodiments, the array of containers 115 may further define one or more container subsections. Each subsection may include a portion of container locations within the array of containers. For example, a container array which defines container locations 115-1 to 115-42 may be segmented into four container subsections. A first container subsection may include container locations 115-1 to 115-3, 115-7 to 115-9, 115-13 to 115-15, and 115-19 to 115-21, a second container subsection may include container locations 115-4 to 115-6, 115-10 to 115-12, 115-16 to 115-18, and 115-22 to 115-24, a third container subsection may include container locations 115-25 to 115-27, 115-31 and 115-33, and 115-37 to 115-39, and a fourth container subsection may include container locations 115-28 to 115-30, 115-34 to 115-36, and 115-40 to 115-42. Each container subsection may define a physical location within the storage area 102. In some embodiments, each container subsection may be associated with one or more sensors 120. The one or more sensors 120 may monitor one or more environmental attributes of the container subsection, such as a temperature attribute, humidity attribute, and/or the like. The main controller 104 may be in communication with the one or more sensors and be configured with the location of the one or more sensors within the storage area 102 and the container subsections arrangement for the storage area 102 such that the main controller 104 is configured to determine and/or monitor the one or more environmental attributes of each container subsection of the storage area 102.

In an embodiment, the storage area 102 can include one or more cooling mechanisms such as, ventilation shafts, fans, or other cooling mechanisms to reduce the ambient temperature in the storage area 102. The cooling mechanisms can selectively cool one or more portions of the storage area 102 that are above a predefined temperature. In some embodiments, the cooling mechanisms can selectively heat one or more portions of the storage area 102 that are below a predefined temperature In other embodiments, the cooling mechanism can include pipes with coolant that are embedded or otherwise attached to the storage area 102 such that when the temperature regulated containers 106 are in the container locations within the storage area 102, the heat producing portion of the temperature regulated container 106 is in thermal contact with the cooling pipes so that the pipes can directly conduct thermal energy away from the containers.

In some embodiments, the main controller 104 may be configured to control the operation of the cooling mechanisms. In an instance that the main controller 104 determines via sensors 120 that one or more environmental attributes, such as temperature, do not satisfy one or more environmental attribute threshold values (e.g., temperature threshold values, humidity threshold values, etc.) for the storage area 102 and/or one or more container subsections, the main controller 104 may activate one or more cooling mechanisms for the storage area 102 and/or one or more container subsections. In some embodiments, each container subsection may have one or more associated environmental attribute threshold values. For example, if a first container subsection has an associated temperature above a threshold temperature value, the main controller 104 may activate one or more fan associated with the first container subsection. The one or more environmental attribute threshold values associated with one container subsection may be different than the one or more environmental attribute threshold values associated with one or more other container subsections. In some embodiments, an environmental attribute may include a temperature attribute, humidity attribute, and/or the like. The main controller 104 may also periodically, semi-periodically, and/or continuously monitor the one or more environmental attributes via the one or more sensors 120 of the storage area 102 and/or container subsections during operation of the one or more cooling mechanisms. In an instance the first container subsection has an environmental attribute that satisfies the one or more threshold environmental attribute values, the main controller 104 may deactivate one or more cooling mechanisms for the storage area 102 and/or main controller 104. By way of continuing example, once one or more sensors associated with the first container subsection detects a temperature that is below a threshold temperature value, the main controller 104 may deactivate the one or more fans associated with the first container subsection. In some embodiments, the main controller 104 may deactivate all the activated cooling mechanisms upon determination that the one or more environmental attributes of the storage area 102 and/or container subsections satisfy the one or more environmental attribute threshold values. In some embodiments, the main controller 104 may deactivate a portion of the activated cooling mechanisms upon determination that the one or more environmental attributes of the storage area 102 and/or container subsections satisfy the one or more environmental attribute threshold values.

The array of containers 115 may include one or more temperature regulated containers 106. In some embodiments, the storage area 102 may further include one or more non-temperature regulated containers. Each temperature regulated container 106 and/or non-temperature regulated container may be configured to store one or more items. In some embodiments, the one or more items stored by the temperature regulated container 106 are a same item type. In some embodiments, the one or more items stored by the temperature regulated container 106 are different items but may be associated with the same recommended storage temperature range. For example, different refrigerated items may be stored within the same temperature regulated container 106. The main controller 104 may be configured to receive and indication of the item contents stored within each temperature regulated container 106 and/or non-temperature regulated container within the storage area 102. In some embodiments the main controller 104 may receive the indication of item contents from one or more associated user devices. In some embodiments, the main controller 104 may be configured to determine a desired temperature range for each temperature regulated container based at least in part on the one or more items stored in the temperature regulated container. Additionally or alternatively, the temperature regulated container may be receive an indication of the temperature for each temperature regulated container. Each temperature regulated container 106 and non-temperature regulated container may be associated with a container identifier, which uniquely identifies the container from one or more other containers. The main controller 104 may be configured to determine and/or monitor the location of each container within the storage area 102.

In some embodiments, a controller system, including main controller 104, can perform one or more functions and operations related to the storage and retrieval system 100. In some embodiments, the main controller 104 includes one or more controllers. In some embodiments, the main controller 104 may be configured to manage the operations of the robotic devices, such as by providing routing and picking commands. The main controller 104 can also provide instructions to temperature regulated containers 106 to maintain specified temperatures based at least in part on the items in the container. In some embodiments, the main controller 104 can receive thermal, vision, and/or acoustic sensor feedback from a sensor system in the storage and retrieval system 100 to help facilitate routing, slotting, and determination of storage locations of the temperature regulated containers 106 and robotic devices 108. In an embodiment, the main controller 104 can be located locally at the storage and retrieval system 100. In some embodiments, the main controller 104 can be located at an edge network node or in the cloud. The hardware device can have embedded software that can be connected securely to the cloud via wired or wireless connection, host the temperature regulating algorithms, slotting algorithms, warehouse control system or warehouse execution systems, and warehouse management systems.

In some embodiments, the one or more temperature regulated containers 106 and/or non-temperature regulated containers are configured to include a local controller. In some embodiments, the local controller may perform one or more of the same operations and/or functions as the main controller 104. In some embodiments, the one or more temperature regulated containers 106 and/or non-temperature regulated containers are configured with a communications component. Each local controller for each container may be in communication with the main controller 104, such as via the respective communication components. The hardware device can have embedded software that can be connected securely to the cloud via wired or wireless connection, host the temperature regulating algorithms, slotting algorithms, warehouse control system or warehouse execution systems, and warehouse management systems.

In some embodiments, the storage and retrieval system includes a sensor system, which includes one or more sensors 120. The sensor system can indicate when a region or area of the storage system is at one or more of predefined temperatures. In some embodiments, the sensor system may include one or more sensors 120 within each container subsection of the storage area 102. The main controller 104 can provide instructions, such as to the one or more robotic devices 108 to move one or more temperature regulated containers 106 to one or more updated placement locations to avoid overheating. In some embodiments, the main controller 104 may provide instructions to individual temperature regulated containers 106 such that the temperature regulated containers 106 may self-propel to one or more updated placement locations. The main controller 104 can also regulate a ventilation system, air-conditioning system, or thermal cooling system based on the sensor feedback, thereby managing waste heat removal and managing efficiency and cooling requirements.

In some embodiments, the storage area 102 may include a charging system that can wirelessly provide charge to the robotic devices and/or the one or more temperature regulated containers 106 via induction and/or wireless power. The charging system can include wires and components that are embedded into the structure of the storage area 102 or attached to the storage area 102. In an embodiment, the one or more temperature regulated containers 106 can be charged while they are sitting in the bays and/or container locations in the storage area 102. In an embodiment, the one or more temperature regulated containers 106 can be charged via one or more robotic devices 108, via the storage area 102 structure while being moved, or at a picking station outside of the storage area 102. In some embodiments, the one or more robotic devices 108 can be charged at predefined charging areas. In some embodiments, the one or more robotic devices 108 can be charged continuously as they move through the storage area 102.

The one or more robotic devices 108 can move both temperature regulated containers 106 and/or non-temperature regulated containers from one placement location to another placement location. The one or more robotic devices 108 may move one or more containers upon receipt of instructions from the main controller 104 to thermally manage the storage system. As will be discussed in greater detail with reference to FIGS. 2A-B, the thermoelectric components of the temperature regulated containers 106 can create waste heat, which may increase the environmental temperature of the surrounding environment. The robotic devices 108 may move one or more containers within the storage area 102 so that the overall ambient temperature of the storage area 102 is moderated and avoid increasing an environmental temperature of the storage area above a predetermined threshold temperature value. In other embodiments, the one or more temperature regulated containers 106 can be moved to areas where the associated thermal energy can be dissipated more readily (e.g., near cooling pipes, air ducts/vents, and/or other cooling/heat dissipation systems).

In an embodiment, the one or more robotic devices 108 and/or the temperature regulated containers 106 can be charged via an inductive charging grid associated with the storage and retrieval system 100. The inductive charging grid can provide power to the one or more robotic devices 108 or the temperature regulated containers 106 via induction or other wireless or contactless power charging systems.

In an embodiment, the storage system can include a communications component 110 that can facilitate communications between the main controller 104 and the one or more temperature regulated containers 106, robotic device 108, and a warehouse control system, warehouse execution system, or warehouse management system located at the storage system, at a network edge device, or in the cloud. In an embodiment, the communications component 110 can communicate with each of the other components using one more of WiFi, Ethernet, or 3GPP communication protocols (4G, 5G or other future protocols), or any other suitable wired or wireless communications protocol.

In an embodiment, the temperature regulated containers 106 and/or non-temperature regulated containers can include a self-propulsion mechanism enabling the containers to move throughout the storage area 102 without the need for the robotic devices 108. The main controller 104 can provide instructions via the communications component 110.

In some embodiments, a temperature of the interior of the temperature regulated containers can be individually set by a main controller 104 and/or a local controller of the temperature regulated container. The main controller 104 and/or local controller which can set the temperature based on the item or type of item within the temperature regulated container 106. The storage area 102 can be organized in such a way that one or more robotic devices, including automated mobile robots, robotic shuttles, and the like, (e.g robotic devices 108) can pass through the storage area 102 to rearrange the containers, vertically and horizontally. The main controller 104 can provide routing instructions to the robotic devices 108 in order to arrange the containers to manage ambient temperature, to minimize route distance for containers that have high product velocity, pick frequency, and other organizations based on slotting algorithms.

Figure 2A:
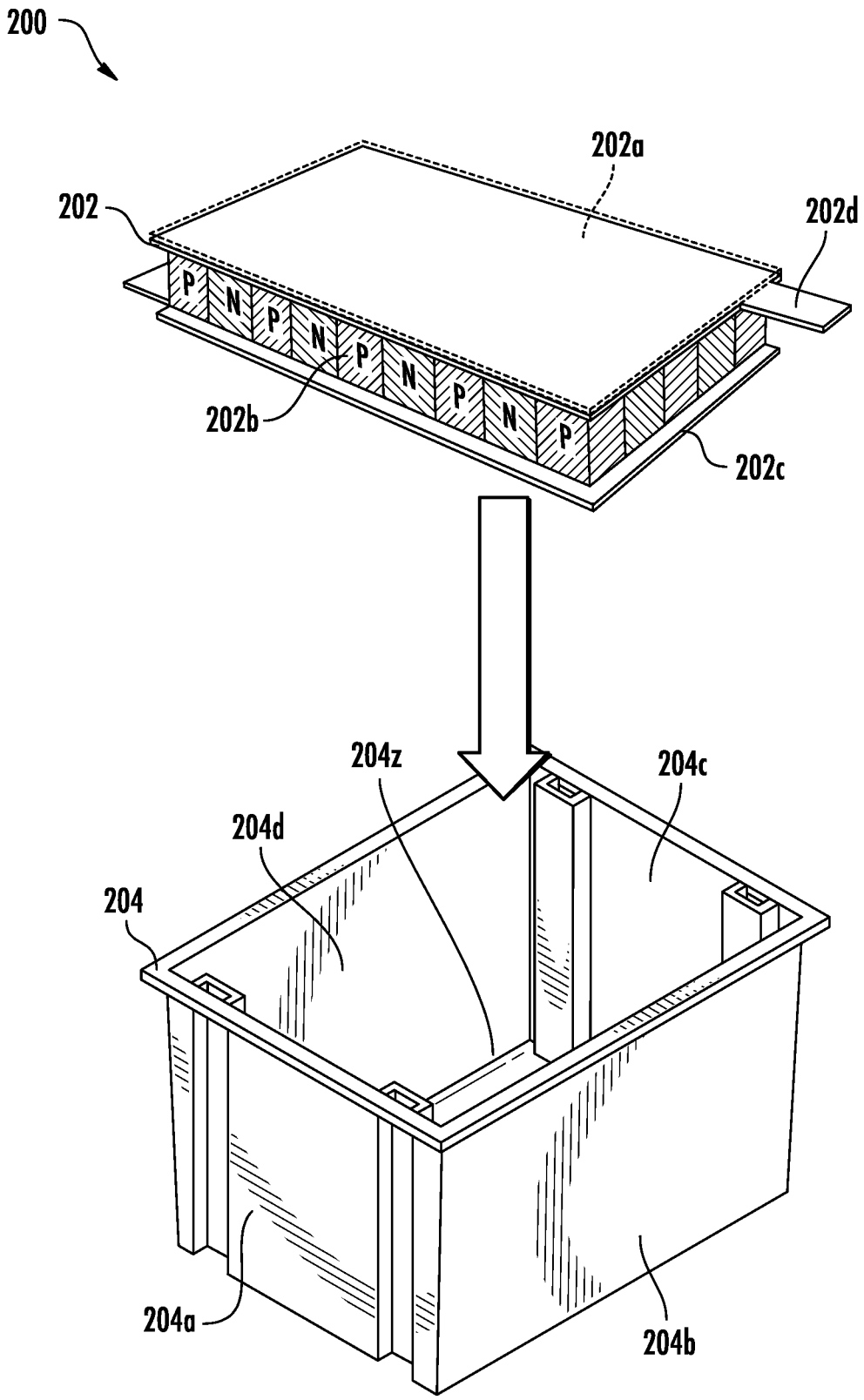
FIGS. 2A and 2B illustrate example embodiments of a temperature regulated container in accordance with various aspects and embodiments of the subject disclosure.
Figure 2B:
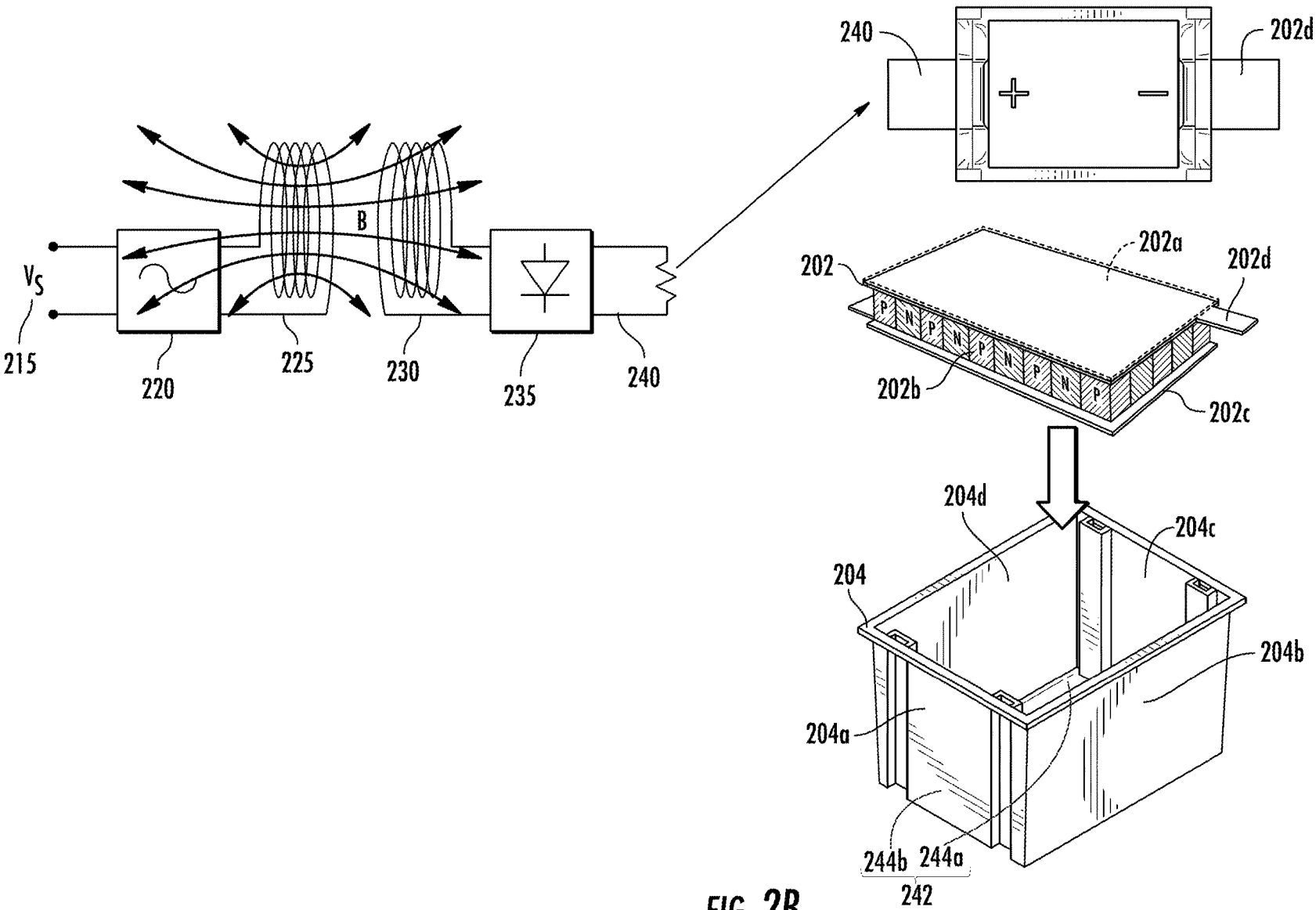

Turning now to FIGS. 2A and 2B, illustrated is an example embodiment of a temperature regulated container 200. The temperature regulated container 200 may include a base container 204. The base container 204 may include at least a base portion, one or more sidewall portions 204*a*, 204*b*, 204*c*, and 204*d*, and a lid portion (not shown). The one or more sidewall portions 204*a-d* may be integrated an interior surface of the base portion. The lid portion may be configured to attach to the one or more sidewall portions 204*a-d*. A base container may define an interior portion 204*z* which is defined by at least the base portion, one or more sidewall portions 204*a-d*, and lid portion of the base container. The interior portion 204*z* of the base container 204 may have an associated volume defined by the space enclosed by the base portion, one or more sidewall portions 204*a-d*, and lid portion. The interior portion 204*z* may be used to store one or more items within the temperature regulated container 200. In some embodiments, the base container 204 may include one or more layers of insulating material. In some embodiments, the one or more layers of insulating material may be placed around and/or embedded within the base portion, the one or more sidewall portions 204*a-d*, and/or the lid portion. The one or more layers of insulating material may insulate the environment of the interior portion 204*z* from surrounding environmental heat. Alternatively, the one or more layers of insulating material may prevent heat from escaping the environment of the interior portion 204*z* in an instance a heated environment is desired for the temperature regulated container 200. Additionally, the one or more sidewall portions 202*a-d* and/or the lid portion of the base container 202 may include a seal configured to at least partially fluidically seal the air from the interior portion 204*z* from the surrounding environmental air. The seal for the one or more sidewall portions 204*a-d* and/or the lid portion may be configured with a seal around at least a portion of the perimeter of the one or more sidewall portions 204*a-d* and/or the lid portion where the sidewalls portions 204*a-d* and lid portion contact one another.

The temperature regulated container 200 may also include one or more thermoelectric components 202. Each thermoelectric component 202 may be disposed within the interior portion 204*z* of the base container 204. In some embodiments, the thermoelectric component 202 may be integrated into the base container 204. In some embodiments, the thermoelectric component 202 may be placed outside of the base container 204. In some embodiments, the thermoelectric component 202 may be placed within the interior portion 204*z* of the base container 204. Each thermoelectric component 202 may include an exterior surface 202*c*, and interior surface 202*a*, and a composite semiconductor layer 202*b* which is disposed between the exterior surface and interior surface. In some embodiments, the thermoelectric component 202 may be placed within the base container 204 such that the exterior surface is adjacent to a base portion, sidewall portion 204*a-d*, or lid portion of the temperature regulated container 200. In some embodiments, each thermoelectric component 202 may span at least a portion of the base portion, one or more sidewall portions 204*a-d*, or the lid portion. For example, a thermoelectric component 202 may have a length dimension smaller than a sidewall portion 204*a* of the temperature regulated container 200 such that the thermoelectric component 202 may only span a portion of the length of sidewall portion 204*a*. In some embodiments, the one or more thermoelectric components 202 may be placed adjacent to one another. In some embodiments, the exterior surface 202*c* may be in direct contact with a sidewall portion 204*a-d*, base portion, or lid portion. In some embodiments, one or more intervening layer may be included in between the exterior surface 202*c* may be in direct contact with a sidewall portion 204*a-d*, base portion, or lid portion. In some embodiments, one or more thermoelectric components 202 may serve as the base portion, one or more sidewall portions 204*a-d*, and/or lid portion of the temperature regulated container 200 such that the exterior surface 202*c* may be exposed to surrounding environment to more efficiently dissipate heat from the temperature regulated container 200.

In some embodiments, the one or more thermoelectric components 202 can be a device that uses the Peltier effect to create a heat flux at the junction of two different types of materials (e.g., using composite semiconductor layer 202*b*). A Peltier cooler, heater, or thermoelectric heat pump can be a solid-state active heat pump which transfers heat from one side of the device to the other, with consumption of electrical energy, depending on the direction of the current. In some embodiments, the thermoelectric component 202 may transfer heat from an interior surface 202*a* to an exterior surface 202*c*. As such, the thermoelectric component may transfer heat from the interior of the temperature regulated container 200 to an outside environment. In some embodiments, the thermoelectric component 202 may transfer heat from an exterior surface 202*c* to an interior surface 202*a*. As such, the thermoelectric component may transfer heat from an outside environment into the interior of the temperature regulated container 200. The direction of heat transfer (e.g., into the temperature regulated container 200 or away from the temperature regulated container 200) may depend on the direction of current which flows through an inductive charging grid. In some embodiments, when a portion of the thermoelectric container (e.g., the exterior surface 202*c*) is exposed to surrounding environmental air, the surrounding environment may act as a heat sink, which may provide for more efficient heat transfer and increase the efficient of the thermoelectric component.

In an embodiment, Peltier devices (e.g., thermoelectric components) can be stacked as heat pumps on top of each other to get one side down to even cryogenic temperatures. For example, triple stacks of thermoelectric components, where each stacked thermoelectric component is smaller than the other are not uncommon. In some embodiments, the composite semiconductor layer 202*b* comprises a semiconductor p-n junction (diode). In some embodiments, the n-type material used within the composite semiconductor layer 202*b* may include a bismuth, telluride, and selenium compound. In some embodiments, the p-type material used within the semiconductor layer may include a bismuth, telluride, and antimony compound. In some embodiments, the composite semiconductor layer 202*b* can achieve up to approximately a 40-50 degrees Celsius difference in temperature provided there is actual heat being pumped. The primary advantages of a thermoelectric component which is a Peltier cooler may include its lack of moving parts or circulating liquid, very long life, invulnerability to leaks, small size, and flexible shape as compared to a vapor-compression refrigerator.

In some embodiments, the base container 204 may include one or more fans and/or other cooling devices within the interior portions 204*z*. The one or more fans may circulate the air within the temperature regulated container and direct the air flow in one or more directions. For example, the one or more fans may be used to direct air flow towards one or more thermoelectric components 202 and/or one or more louvre sets (as will be discussed in further detail with respect to FIG. 3B). In some embodiments, the one or more fans may be integrated into the base portion, the one or more sidewall portions 204*a-b*, and/or one or more lid portions. In some embodiments, one or more fans may be positioned adjacent to or onto the interior surface 202*a* and/or exterior surface 202*c* of one or more thermoelectric components 202. As such, the one or more fans may provide forced convection of the surfaces of the one or more thermoelectric components and aid in air circulation and/or heat dissipation from the thermoelectric component surfaces, resulting in more efficient heat transfer.

In some embodiments, the base container 204 may include one or more sensors, such as thermometers, hygrometers, pressure sensors, load sensors, and/or the like positioned on or around and/or embedded within the base portion, one or more sidewall portions 204*a-b*, and/or lid portion of the base container 204. In some embodiments, the one or more sensors may measure environmental attribute measures of the interior of the temperature regulated container 200. In some embodiments, the environmental attribute measures may include measuring the temperature, humidity, and/or the like for the interior of the temperature regulated container. In some embodiments, the one or more sensors may be externally positioned on the base container 204 such that the environmental attributes of the external environment of the temperature regulated container is measured. In some embodiments, the one or more sensors may indicate when frost has built up within the interior portion 204*z* of the temperature regulated container 200. In an instance the one or more sensors indicate a frost build up, a local controller of the temperature regulated container 200 and/or the main controller 104 may be configured to generate and provide one or more warning data objects to one or more user devices. In some embodiments, the base container 204 may further include one or more drain plugs. The one or more drain plugs may be positioned in the base portion, one or more sidewall portions 204*a-b*, and/or lid portion and may provide a fluid opening to the environment. The one or more drain plugs may be used to drain any liquid within the temperature regulated container 200, such as due to the melting of frost build-up. The one or more sensors may be communicatively couple with the local controller of the temperature regulated container and/or the main controller 104.

The base container 204 may include an inductive charging grid 242. In some embodiments, the inductive charging grid 242 is integrated within the base container 204. The inductive charging grid 242 may be configured to induce a current within the one or more thermoelectric components 202. In some embodiments, the inductive charging grid 242 may include one or more inductive charging grid sections. The inductive charging grid 242 may individually provide charge to each inductive charging grid section. In some embodiments, each inductive charging grid section is configured to provide current to one or more thermoelectric components within a portion of the base container 204. For example, a first inductive charging grid section 244*a* may be configured to provide current to one or more thermoelectric components 202 of a base portion of the base container 204 and a second inductive charging grid section 244*b* may be configured to provide current to one or more thermoelectric components 202 of a sidewall portion 204*a* of the base container 204. In some embodiments, the inductive charging grid 242 is powered by one or more batteries, the charging system, a third grid power supply, etc. In some embodiments, as shown in FIG. 3B, a direct connection 310, may be used to directly supply power to the inductive charging grid.

In some embodiments, the inductive charging grid may be configured to be powered using one or more batteries. The one or more batteries may be stored within the temperature regulated container 200. As such, the temperature regulated container 200 may be configured to provide charge to the inductive charging grid, and by extensions, the one or more thermoelectric components without reliance on a charging system of the storage system. In some embodiments, the controller (either the local controller of the temperature regulated container and/or the main controller 104) may be configured to select which power source (e.g., batteries, charging system of the storage and retrieval system, third rail power supply) to use to power the inductive charging grid and/or one or more other components.

In some embodiments, the temperature regulated container 200 may be configured to store one or more items, such as perishables and/or medications. In some embodiments, the temperature regulated container 200 may be configured with a visual indication on the exterior of the temperature regulated container 200 indicative of the contents stored within the temperature regulated container 200. For example, the visual indication may include a a light emitting diode (LED), where the color of the LED corresponds to a particular class of stored items. As an example, a red LED may indicate the items stored by the temperature regulated container include refrigerated medications, a blue LED may indicate the items stored by the temperature regulated container include freezer perishables, etc. In some embodiments, at least a portion of the external color of the temperature regulated container 200 may indicate the particular class of stored items within the temperature container. For example, a red colored base container for a temperature regulated container 200 may indicate the items stored by the temperature regulated container include refrigerated medications, a blue colored base container for a temperature regulated container 200 may indicate the items stored by the temperature regulated container include freezer perishables, etc. In some embodiments, only a portion of the base container temperature regulated container need be colored and/or marked with a particular marking or other indicia to indicate the items stored by the temperature regulated container.

In some embodiments, the temperature regulated container 200 may be configured with a wireless transmitter, such as a near-field communications (NFC) transmitter or Bluetooth transmitter. The wireless transmitter may indicate the items stored by the particular container to one or more associated external user devices. In some embodiments, the temperature regulated container 200 is associated with a barcode. The barcode for the temperature regulated container 200 may be associated with a unique barcode such that the temperature regulated container 200 is uniquely identifiable and may be indicative of the items stored by the temperature regulated container 200. The barcode may be scanned using one or more external user devices, such as a scanner, to identify the temperature regulated container 200 and the items stored by the temperature regulated container 200. In some embodiments, the wireless transmitter and/or barcode for a temperature regulated container 200 may also indicate one or more malfunctions, errors, and/or faults within the temperature regulated container 200.

As shown in FIG. 2B, the one or more thermoelectric components 202 may be powered using a power source 215 which may pass current through an oscillator 220, which may convert a direct current signal to a periodic alternating current signal. In some embodiments, the power source 215 is one or more batteries. The one or more batteries may be attached the temperature regulated container 200. In some embodiments, the power source 215 is a current line connected to a charging system. In some embodiments, the power source 215 is an electrical connection to a third rail power supply. The current may then flow through a first coil 225 with n turns and induce a magnetic field B. The direction of the current blow may determine the direction of the magnetic field B. The number of turns n in the first coil may be greater than one. The second coil 230 may feel the effects of the induced magnetic field B and produce a current in response. In some embodiments, the second coil 230 may also have n turns. The current may pass through rectifier 235, which may convert the two-directional alternating current into a single-directional direct current which may serve as the load 240. In some embodiments, this load 240 may serve as the load to power the thermoelectric component 202. In some embodiments, the direction of the produced current may be based at least in part on the direction of the magnetic field B. Furthermore, the direction of the produced current that flows through the thermoelectric components 202 may determine the direction of heat flow (e.g., away from the interior of the temperature regulated container 200 or into the interior of the temperature regulated container 200).

In some embodiments, one or more third rail power supply lines may be included the storage area and traverse through one or more container locations. The one or more third rail power supply lines may be connected to the charging system of the storage and retrieval system 100. A third rail power supply line may be used to supply power to the inductive charging grid of a temperature regulated container and/or may be used to supply power directly to the one or more thermoelectric components. The one or more third rail power supply lines may also supply power to one or more other electrical components of the temperature regulated container, such as one or more LEDs, Bluetooth transmitters, etc. In some embodiments, the one or more third rail power supply lines may also be used for powerline communications.

In some embodiments, the temperature regulated container 200 may include a local controller (not shown). The local controller may one or more operations of the main controller 104 for the temperature regulated container 200. In some embodiments, local controller may be configured to provide instructions to temperature regulated containers 106 to maintain specified temperatures based at least in part on the items in the container. In some embodiments, local controller can receive sensor feedback from a sensor system in the temperature regulated container. In some embodiments, the local controller may be configured to determine whether one or more environmental attribute values of the temperature regulated container 200 satisfy one or more threshold environmental attribute threshold values. In some embodiments, a local controller may be configured to actuate one or more louvre sets between one or more configurations, activate and/or deactivate one or more inductive charging grid sections of an inductive charging grid, and/or provide one or more warning data objects to one or more user devices in an instance one or more trigger events occurs. In some embodiments, one or more trigger events include determination that one or more temperature values do not satisfy one or more temperature threshold values, one or more humidity values do not satisfy one or more humidity threshold values, or a maintenance time duration satisfies one or more maintenance time durations, and/or the like. In an embodiment, the local controller can be located locally at the temperature regulated container 200. The hardware device can have embedded software that can be connected securely to the cloud via wired or wireless connection, host the temperature regulating algorithms, slotting algorithms, warehouse control system or warehouse execution systems, and warehouse management systems.

In some embodiments, a temperature regulated container 200 includes a communications component that can facilitate communications between the temperature regulated container 200, the main controller 104, robotic devices 108, and a warehouse control system, warehouse execution system, or warehouse management system located at the storage system, at a network edge device, or in the cloud. In an embodiment, the communications component can communicate with each of the other components using one more of WiFi, Ethernet, or 3GPP communication protocols (4G, 5G or other future protocols), or any other suitable wired or wireless communications protocol.

Figure 3A:
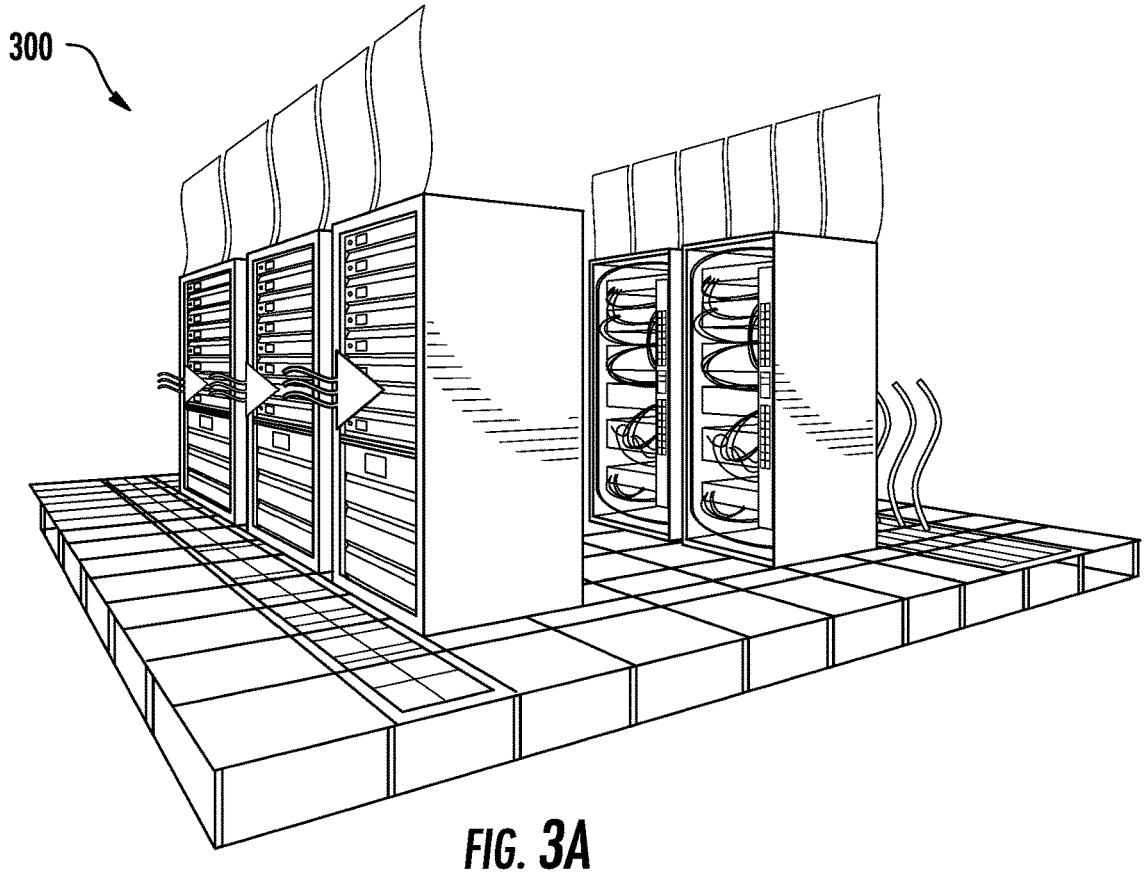
FIGS. 3A and 3B illustrate example embodiments of a temperature controlled storage and retrieval system in accordance with various aspects and embodiments of the subject disclosure.
Figure 3B:
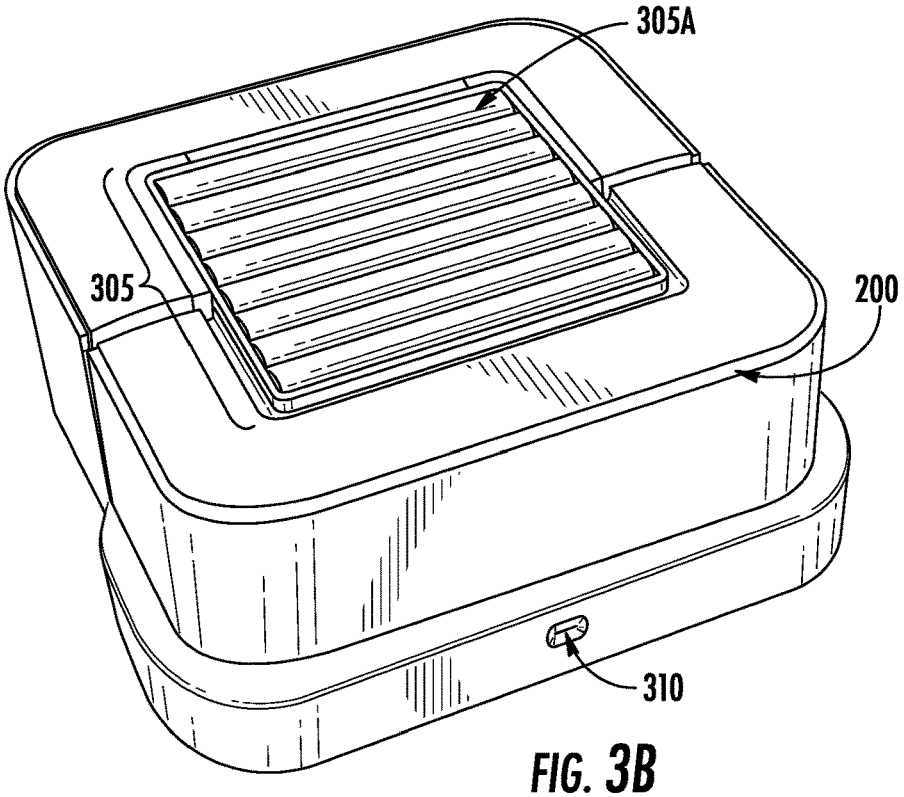

Turning now to FIG. 3A and 3B, illustrated are example embodiments of a storage and retrieval system 300. In an embodiment, a storage and retrieval system 300 can include a cooling system or heating, ventilation, and air conditioning (HVAC) system that can selectively cool down portions of a storage and retrieval system. In the embodiment shown in FIG. 3A, the area to be cooled is a data center, but a similar implantation can be used in a storage system, where rows, or columns of storage areas can be cooled selectively based on a feedback from a sensor system within the storage and retrieval system that can indicate a local temperature for the storage area and/or one or more container subsections being above a predefined temperature value. In some embodiments, one or more ventilation shafts, fans, or other cooling mechanisms to reduce the ambient temperature of the storage and retrieval system 300. In some embodiments, a cooling mechanism can include pipes with coolant that are embedded or otherwise attached to the storage and retrieval system 300 such that when the temperature regulated containers 106 are in the container locations within a storage area, the heat producing portion of the temperature regulated container 106 is in thermal contact with the cooling pipes so that the pipes can directly conduct thermal energy away from the containers.

In some embodiments, the main controller 104 may selectively actuate one or more of the cooling mechanisms. The main controller 104 may actuate one or more of the cooling mechanisms in response to detection by one or more sensors that an environmental attribute does not satisfy one or more environmental attribute threshold values. The one or more environmental attributes may include a temperature attribute, humidity attribute, and/or the like.

As shown in FIG. 3B, a temperature regulated container 200 is shown in accordance with an example embodiment. In an embodiment, the base container of the temperature regulated container 200 may include one or more louvre sets 305. Each louvre set 305 can actively open or close to increase or decrease airflow. In some embodiments, each louvre set includes one or more louvres 305A which are configured to actuate as a unit. For example, in response to actuation, either passively or automatically, the louvre set 305 may adjust positions to control the airflow into and/or away from the temperature regulated container 200. The louvre set 305 may define and open configuration, where maximum airflow between the temperature regulated container 200 and the surrounding environment is achieved and a closed configuration, where minimal to no airflow between the temperature regulated container 200 and the surrounding environment is achieved. Intermediary configurations between a closed configuration and open configuration are also possible. In an instance where the louvre set 305 is not in a closed configuration, air flow may occur between the interior portion of the base container and the surrounding external environment of the base container.

In some embodiments, the louvre sets 305 are passive such that they require manual actuation to switch between configurations. In some embodiments, the louvre sets 305 are automatic such that the main controller 104 and/or local controller may actuate the one or more louvre sets.

In some embodiments, the temperature regulated container may include a direct connection 310, which may allow for a power supply to be connected to the one or more thermoelectric components 202 of the temperature regulated container. The direct connection 310 may also provide power to the one or more additional electrical components of the temperature regulated container, such as the one or more louvre sets, wireless transmitters, LEDS, and/or the like. In some embodiments, the direct connection 310 may be a universal serial bus (USB) port.

Figure 4:
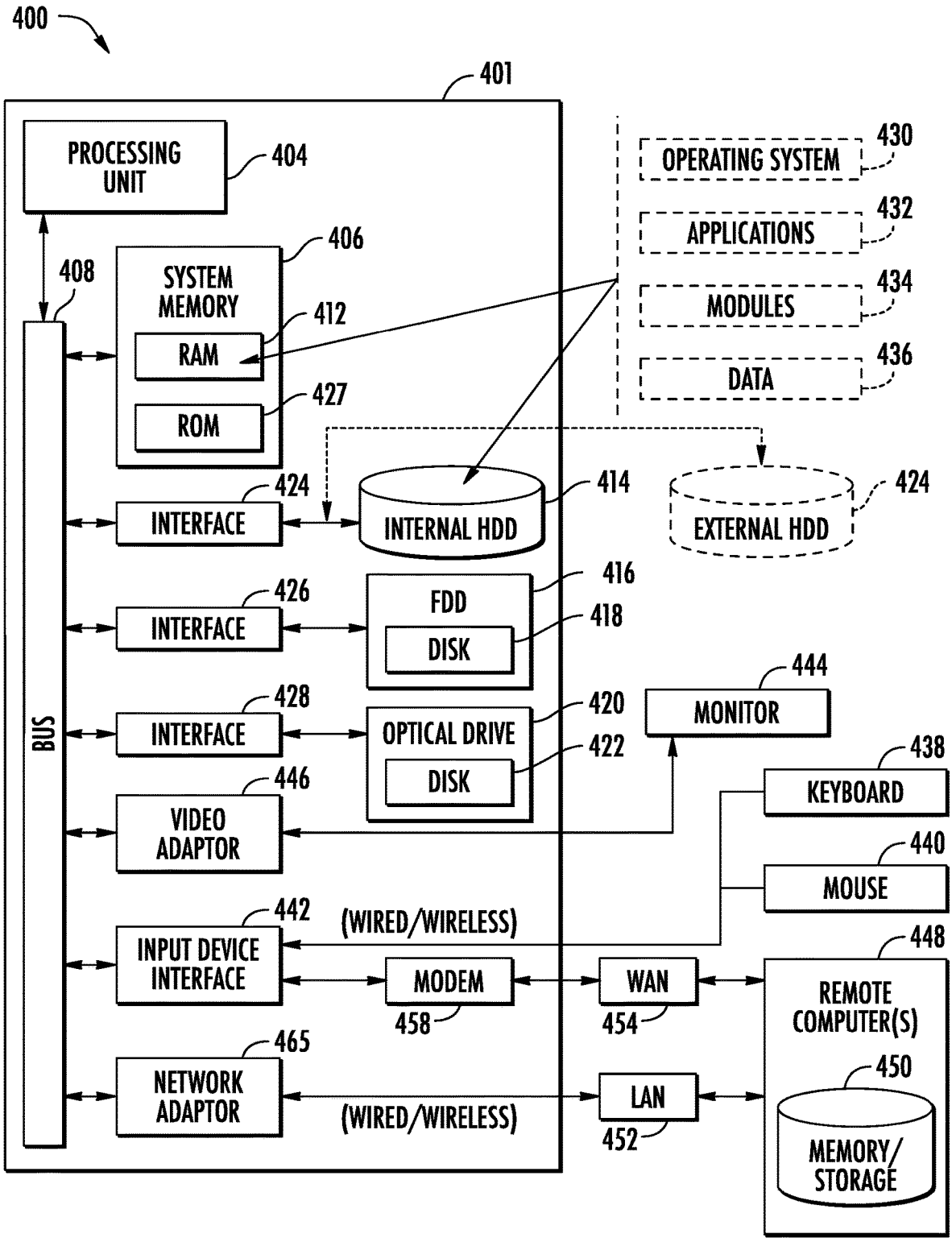
FIG. 4 illustrates an example block diagram of a computer that can be operable to execute processes and methods in accordance with various aspects and embodiments of the subject disclosure.

Referring now to FIG. 4, there is illustrated a block diagram of a computer 400 operable to execute the functions and operations performed in the described example embodiments. For example, a computing device (e.g., controller or processor associated with the storage and retrieval system 100) may contain components as described in FIG. 1. The computer 400 can provide networking and communication capabilities between a wired or wireless communication network and a server and/or communication device. In order to provide additional context for various aspects thereof, FIG. 1 and the following discussion are intended to provide a brief, general description of a suitable computing environment in which the various aspects of the embodiments can be implemented to facilitate the establishment of a transaction between an entity and a third party. While the description above is in the general context of computer-executable instructions that can run on one or more computers, those skilled in the art will recognize that the various embodiments also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the various embodiments can also be practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media or communications media, which two terms are used herein differently from one another as follows.

Computer-readable storage media can be any available storage media that can be accessed by the computer and includes both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

Communications media can embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference to FIG. 4, implementing various aspects described herein with regards to the end-user device can include a computer 400, the computer 400 including a processing unit 404, a system memory 406 and a system bus 408. The system bus 408 couples system components including, but not limited to, the system memory 406 to the processing unit 404. The processing unit 404 can be any of various commercially available processors. Dual microprocessors and other multi-processor architectures can also be employed as the processing unit 404.

The system bus 408 can be any of several types of bus structure that can further interconnect to a memory bus (with or without a memory controller), a peripheral bus, and a local bus using any of a variety of commercially available bus architectures. The system memory 406 includes read-only memory (ROM) 427 and random access memory (RAM) 412. A basic input/output system (BIOS) is stored in a non-volatile memory 427 such as ROM, EPROM, EEPROM, which BIOS contains the basic routines that help to transfer information between elements within the computer 400, such as during start-up. The RAM 412 can also include a high-speed RAM such as static RAM for caching data.

The computer 400 further includes an internal hard disk drive (HDD) 414 (e.g., EIDE, SATA), which internal hard disk drive 414 can also be configured for external use in a suitable chassis (not shown), a magnetic floppy disk drive (FDD) 416, (e.g., to read from or write to a removable diskette 418) and an optical disk drive 420, (e.g., reading a CD-ROM disk 422 or, to read from or write to other high capacity optical media such as the DVD). The hard disk drive 414, magnetic disk drive 416 and optical disk drive 420 can be connected to the system bus 408 by a hard disk drive interface 424, a magnetic disk drive interface 426 and an optical drive interface 428, respectively. The interface 424 for external drive implementations includes at least one or both of Universal Serial Bus (USB) and IEEE 1394 interface technologies. Other external drive connection technologies are within contemplation of the subject embodiments.

The drives and their associated computer-readable media provide nonvolatile storage of data, data structures, computer-executable instructions, and so forth. For the computer 400 the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer 400, such as zip drives, magnetic cassettes, flash memory cards, cartridges, and the like, can also be used in the example operating environment, and further, that any such media can contain computer-executable instructions for performing the methods of the disclosed embodiments.

A number of program modules can be stored in the drives and RAM 412, including an operating system 430, one or more application programs 432, other program modules 434 and program data 436. All or portions of the operating system, applications, modules, and/or data can also be cached in the RAM 412. It is to be appreciated that the various embodiments can be implemented with various commercially available operating systems or combinations of operating systems.

A user can enter commands and information into the computer 400 through one or more wired/wireless input devices, e.g., a keyboard 438 and a pointing device, such as a mouse 440. Other input devices (not shown) may include a microphone, an IR remote control, a joystick, a game pad, a stylus pen, touch screen, or the like. These and other input devices are often connected to the processing unit 404 through an input device interface 442 that is coupled to the system bus 408, but can be connected by other interfaces, such as a parallel port, an IEEE 1394 serial port, a game port, a USB port, an IR interface, etc.

A monitor 444 or other type of display device is also connected to the system bus 408 through an interface, such as a video adapter 446. In addition to the monitor 444, a computer 400 typically includes other peripheral output devices (not shown), such as speakers, printers, etc.

The computer 400 can operate in a networked environment using logical connections by wired and/or wireless communications to one or more remote computers, such as a remote computer(s) 448. The remote computer(s) 448 can be a workstation, a server computer, a router, a personal computer, portable computer, microprocessor-based entertainment device, a peer device or other common network node, and typically includes many or all of the elements described relative to the computer, although, for purposes of brevity, only a memory/storage device 450 is illustrated. The logical connections depicted include wired/wireless connectivity to a local area network (LAN) 452 and/or larger networks, e.g., a wide area network (WAN) 454. Such LAN and WAN networking environments are commonplace in offices and companies, and facilitate enterprise-wide computer networks, such as intranets, all of which may connect to a global communications network, e.g., the Internet.

When used in a LAN networking environment, the computer 400 is connected to the local network 452 through a wired and/or wireless communication network interface or adapter 456. The adapter 456 may facilitate wired or wireless communication to the LAN 452, which may also include a wireless access point disposed thereon for communicating with the wireless adapter 456.

When used in a WAN networking environment, the computer 400 can include a modem 458, or is connected to a communications server on the WAN 454, or has other means for establishing communications over the WAN 454, such as by way of the Internet. The modem 458, which can be internal or external and a wired or wireless device, is connected to the system bus 408 through the input device interface 442. In a networked environment, program modules depicted relative to the computer, or portions thereof, can be stored in the remote memory/storage device 450. It will be appreciated that the network connections shown are exemplary and other means of establishing a communications link between the computers can be used.

The computer is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE802.11 (a, b, g, n, etc.) to provide secure, reliable, fast wireless connectivity. A Wi-Fi network can be used to connect computers to each other, to the Internet, and to wired networks (which use IEEE802.3 or Ethernet). Wi-Fi networks operate in the unlicensed 2.4 and 5 GHz radio bands, at an 11 Mbps (802.11b) or 54 Mbps (802.11a) data rate, for example, or with products that contain both bands (dual band), so the networks can provide real-world performance similar to the basic "10BaseT" wired Ethernet networks used in many offices.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor also can be implemented as a combination of computing processing units.

In the subject specification, terms such as "store," "data store," "data storage," "database," "repository," "queue", and substantially any other information storage component relevant to operation and functionality of a component, refer to "memory components," or entities embodied in a "memory" or components comprising the memory. It will be appreciated that the memory components described herein can be either volatile memory or nonvolatile memory, or can comprise both volatile and nonvolatile memory. In addition, memory components or memory elements can be removable or stationary. Moreover, memory can be internal or external to a device or component, or removable or stationary. Memory can comprise various types of media that are readable by a computer, such as hard-disc drives, zip drives, magnetic cassettes, flash memory cards or other types of memory cards, cartridges, or the like.

By way of illustration, and not limitation, nonvolatile memory can comprise read only memory (ROM), programmable ROM (PROM), electrically programmable ROM (EPROM), electrically erasable ROM (EEPROM), or flash memory. Volatile memory can comprise random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated example aspects of the embodiments. In this regard, it will also be recognized that the embodiments comprise a system as well as a computer-readable medium having computer-executable instructions for performing the acts and/or events of the various methods.

Computing devices typically comprise a variety of media, which can comprise computer-readable storage media and/or communications media, which two terms are used herein differently from one another as follows. Computer-readable storage media can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data, or unstructured data.

Computer-readable storage media can include, but are not limited to, random access memory (RAM), read only memory (ROM), electrically erasable programmable read only memory (EEPROM), flash memory or other memory technology, solid state drive (SSD) or other solid-state storage technology, compact disk read only memory (CD ROM), digital versatile disk (DVD), Blu-ray disc or other optical disk storage, magnetic cassettes, magnetic tape, magnetic disk storage or other magnetic storage devices or other tangible and/or non-transitory media which can be used to store desired information.

In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal such as a modulated data signal, e.g., a carrier wave or other transport mechanism, and comprises any information delivery or transport media. The term "modulated data signal" or signals refers to a signal that has one or more of its characteristics set or changed in such a manner as to encode information in one or more signals. By way of example, and not limitation, communications media comprise wired media, such as a wired network or direct-wired connection, and wireless media such as acoustic, RF, infrared and other wireless media Further, terms like "user equipment," "user device," "mobile device," "mobile," station," "access terminal," "terminal," "handset," and similar terminology, generally refer to a wireless device utilized by a subscriber or user of a wireless communication network or service to receive or convey data, control, voice, video, sound, gaming, or substantially any data-stream or signaling-stream. The foregoing terms are utilized interchangeably in the subject specification and related drawings. Likewise, the terms "access point," "node B," "base station," "evolved Node B," "cell," "cell site," and the like, can be utilized interchangeably in the subject application, and refer to a wireless network component or appliance that serves and receives data, control, voice, video, sound, gaming, or substantially any data-stream or signaling-stream from a set of subscriber stations. Data and signaling streams can be packetized or frame-based flows. It is noted that in the subject specification and drawings, context or explicit distinction provides differentiation with respect to access points or base stations that serve and receive data from a mobile device in an outdoor environment, and access points or base stations that operate in a confined, primarily indoor environment overlaid in an outdoor coverage area. Data and signaling streams can be packetized or frame-based flows.

Furthermore, the terms "user," "subscriber," "customer," "consumer," and the like are employed interchangeably throughout the subject specification, unless context warrants particular distinction(s) among the terms. It should be appreciated that such terms can refer to human entities, associated devices, or automated components supported through artificial intelligence (e.g., a capacity to make inference based on complex mathematical formalisms) which can provide simulated vision, sound recognition and so forth. In addition, the terms "wireless network" and "network" are used interchangeable in the subject application, when context wherein the term is utilized warrants distinction for clarity purposes such distinction is made explicit.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while a particular feature may have been disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

Figure 5:
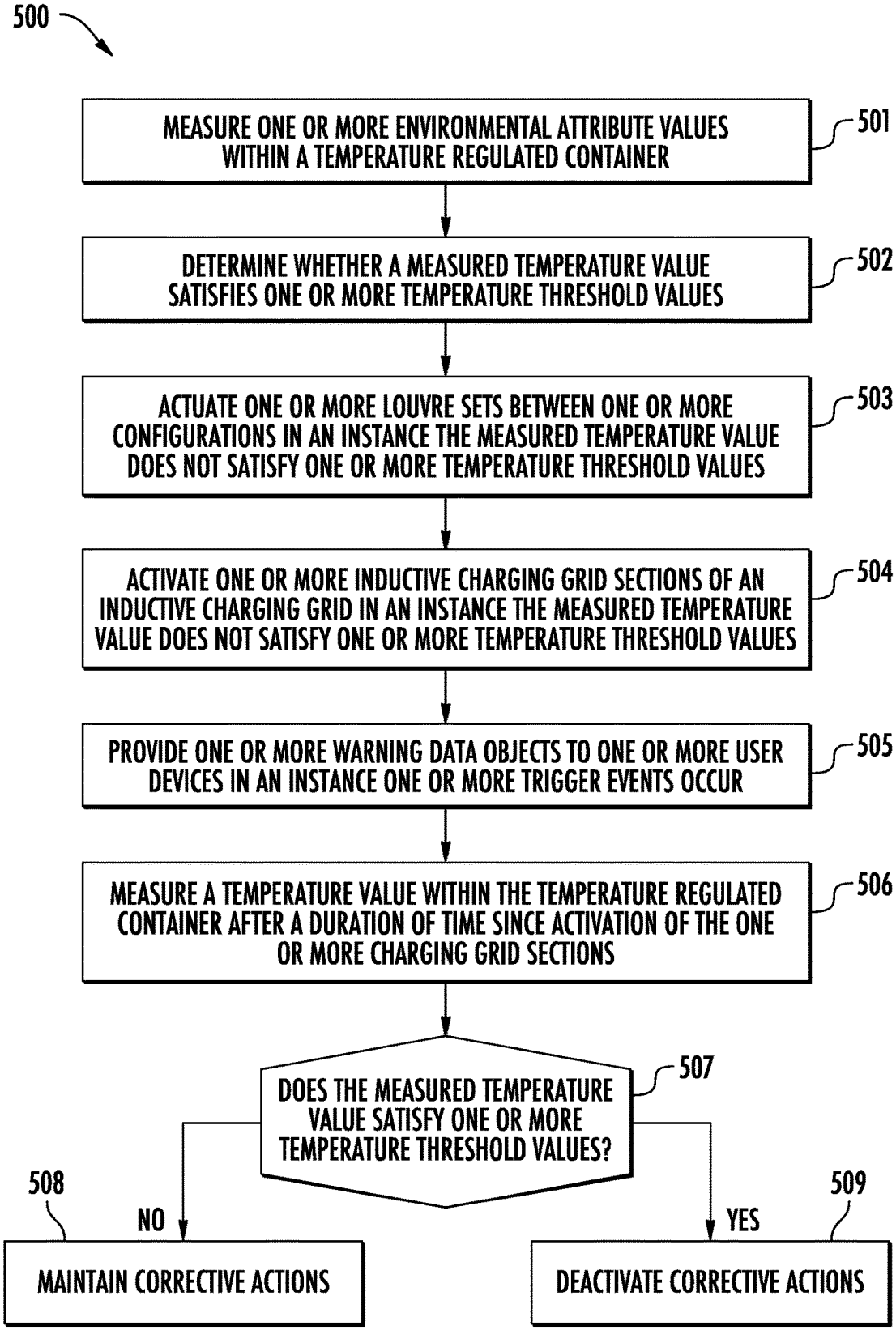
FIG. 5 provides a flowchart diagram of an example process for controlling an internal temperature of a temperature regulated container in accordance with various aspects and embodiments of the subject disclosure.

FIG. 5 is a flowchart diagram of an example process 500 for the maintaining one or more environmental attributes of a temperature regulated container 200. Via the various steps/operations of the process 500, one or more environmental attributes of the temperature regulated container 200 may be determined and/or maintained such that the items stored within the temperature regulated container 200 are stored within one or more desired environmental attribute ranges.

The process 500 begins at step/operation 501 one or more sensors of the temperature regulated container 200 measures one or more environmental attributes within the temperature regulated container 200. In some embodiments, the one or more environmental attributes includes one or more temperature values, humidity values, and/or the like. In some embodiments, the one or more sensors of the temperature regulated container 200 may be configured to measure the one or more environmental attributes periodically, semi-periodically, and/or upon request from one or more user devices. The local controller and/or main controller 104 may take one or more corrective actions based at least in part on the one or more measured environmental attributes.

At step/operation 502, the local controller of the temperature regulated container 200 and/or the main controller 104 may determine whether a measured temperature value satisfies one or more temperature threshold values. The one or more temperature threshold values may be based at least in part on the one or more items stored in the temperature regulated container 200. The local controller and/or main controller 104 may receive an indication of the one or more temperature threshold values and/or may receive an indication of the one or more items stored within the temperature regulated container 200 such that the local controller and/or main controller 104 are configured to determine one or more temperature threshold values.

Optionally, at step/operation 503, in an instance the measured temperature value does not satisfy one or more temperature value thresholds, the local controller of the temperature regulated container 200 and/or the main controller 104 may take a corrective action which may include actuating one or more louvre sets of the temperature regulated container 200 between one or more configurations. In some embodiments, if the measured temperature value does not satisfy one or more temperature value thresholds, the local controller and/or main controller 104 may change the configuration of one or more associated louvre sets associated with the temperature regulated container to a more open configuration. For example, if the measured temperature is determined to be above a temperature value threshold, the main controller 104 and/or local controller may determine to change the configuration of the associated louvre set to a more open configuration, thereby allowing more heat to escape the temperature regulated container 200. As another example, if the measured temperature is determined to be below a temperature value threshold, the main controller 104 and/or local controller may determine to change the configuration of the associated louvre set to a more closed configuration, thereby retaining more heat within the temperature regulated container 200.

Optionally, at step/operation 504, in an instance the measured temperature value does not satisfy one or more temperature value thresholds, the local controller of the temperature regulated container 200 and/or the main controller 104 may take a corrective action which includes activating one or more inductive charging grid sections of an inductive charging grid for the temperature regulated container 200. In some embodiments, step/operation 504 may be performed instead of or in addition to step/operation 503. The particular step/operation selected by the local controller and/or main controller 104 may be based at least in part on the particular configuration of the temperature regulated container 200, one or more user preferences, one or more storage and retrieval system preferences, and/or the like. Upon activation of the one or more inductive charging grid sections, the one or more thermoelectric components corresponding to the activation inductive charging grid sections may become activated such that a heat transfer may occur. The local controller and/or main controller 104 may choose a current direction for the activation of the one or more inductive charging grid sections, which may in turn determine the direction of heat transfer (e.g., away from the interior of the temperature regulated container or into the interior of the temperature regulated container).

Optionally, at step/operation 505, the local controller of the temperature regulated container 200 and/or the main controller 104 may take a corrective action which includes providing one or more warning data objects to one or more user devices in an instance one or more trigger events occur. The one or more trigger events include determination that one or more temperature values do not satisfy one or more temperature threshold values, one or more humidity values do not satisfy one or more humidity threshold values, or a maintenance time duration satisfies one or more maintenance time durations. A maintenance time duration may be defined as the time between the current time and the most recent maintenance performed on the temperature regulated container 200. In some embodiments, the local controller and/or main controller 104 may be configured to generate and provide a warning data object to one or more associated user devices such that one or more end users of the one or more associated user devices are informed of the occurrence of the one or more trigger events.

At step/operation 506, one or more sensors of the temperature regulated container 200 measures one or more environmental attributes within the temperature regulated container 200 after a duration of time since activation of the one or more inductive charging grid sections. In some embodiments, the one or more sensors may be configured to measure the temperature of the temperature regulated container 200 periodically, semi-periodically, and/or upon demand. The duration of time between the one or more measurements may be configured by the local controller and/or main controller 104. In some embodiments, the duration of time is based at least in part on the one or more items stored within the temperature regulated container, the one or more temperature threshold values for the temperature regulated container, and/or the like.

At step/operation 507, the local controller of the temperature regulated container 200 and/or the main controller 104 may determine whether the measured temperature value satisfies one or more temperature threshold values. As such, the local controller and/or main controller 104 may evaluate the temperature of the temperature regulated container to determine whether the measured temperature value satisfies the one or more temperature threshold values. The main controller 104 and/or local controller may then take one or more corrective actions depending on whether the measured temperature value satisfies the one or more temperature threshold values.

The flow may proceed to step/operation 508 in an instance the measured temperature value does not satisfy one or more temperature threshold values. At step/operation 508, the local controller of the temperature regulated container 200 and/or the main controller 104 may determine to maintain the corrective action. For example, the local controller and/or main controller 104 may determine to maintain the activation of the one or more inductive charging grid sections of the inductive charging grid. Additionally or alternatively, in some embodiments, the local controller of the temperature regulated container 200 and/or the main controller 104 may determine to take one or more additional corrective actions. For example, a local controller and/or main controller 104 may determine to activate one or more additional inductive charging grid sections of the inductive charging grid. If the local controller previously activated one or more inductive charging grid sections of the inductive charging grid, the local controller may additionally actuate one or more louvre sets to a more open position in response to a determination that the temperature value still does not satisfy the one or more temperature threshold values. The process described by step/operations 506-507 may iteratively repeat until the flow proceeds to step/operation 509.

The flow may proceed to step/operation 509 in an instance the measured temperature value satisfies one or more temperature threshold values. At step/operation 508, the local controller of the temperature regulated container 200 and/or the main controller 104 may determine to deactivate one or more corrective actions. For example, the main controller 104 and/or local controller may determine to deactivate the one or more inductive charging grid sections of the inductive charging grid.

The step/operations described by FIG. 5 may be performed iteratively such that the local controller and/or main controller 104 may determine whether to activate, maintain, or deactivate one or more corrective actions in real-time or near real-time based at least in part on recent sensor measurements.

Figure 6:
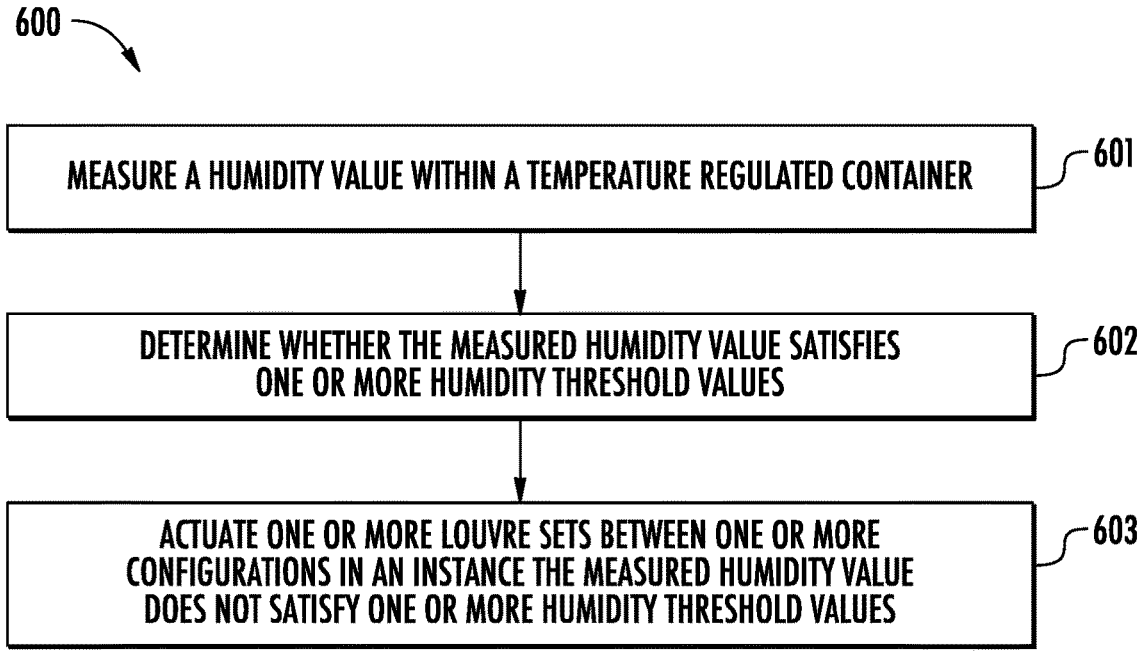
FIG. 6 provides a flowchart diagram of an example process for controlling an internal humidity of a temperature regulated container in accordance with various aspects and embodiments of the subject disclosure.

In some embodiments, step/operations 501 can be performed in accordance with the process depicted in FIG. 6. The process depicted in FIG. 6 begins at step/operation 601.

The process 600 begins at step/operation 601, when one or more sensors of the temperature regulated container 200 measures a humidity value within the temperature regulated container 200. The local controller and/or main controller 104 may take one or more corrective actions based at least in part on the one or more measured humidity value within the temperature regulated container 200.

At step/operation 602, the local controller of the temperature regulated container 200 and/or the main controller 104 may determine whether the measured humidity value satisfies one or more temperature threshold values. The one or more humidity threshold values may be based at least in part on the one or more items stored in the temperature regulated container 200. The local controller and/or main controller 104 may receive an indication of the one or more humidity threshold values and/or may receive an indication of the one or more items stored within the temperature regulated container 200 such that the local controller and/or main controller 104 is configured to determine one or more humidity threshold values.

Optionally, at step/operation 603, in an instance the measured humidity value does not satisfy one or more humidity value thresholds, the local controller of the temperature regulated container 200 and/or the main controller 104 may actuate one or more louvre sets between one or more configurations. For example, if a measured humidity value is above a threshold humidity value, the main controller 104 and/or local controller may actuate the one or more louvre sets to a more open position allow for moisture to escape the temperature regulated container 200. As another example, if a measured humidity value is below a threshold humidity value, the main controller 104 and/or local controller may actuate the one or more louvre sets to a more closed position to prevent environmental moisture from entering the temperature regulated container 200. In some embodiments, actuating a louvre set to a more open configuration includes switching to the open configuration. In some embodiments, actuating a louvre set to a more open configuration includes switching to the louvre set from a closed configuration or intermediate configuration to an intermediate configuration which is more open. The step/operations described by FIG. 6 may be performed iteratively such that the local controller and/or main controller 104 may determine a configuration of the one or more louvre sets in real-time or near real-time based at least in part on recent sensor measurements.

Figure 7:
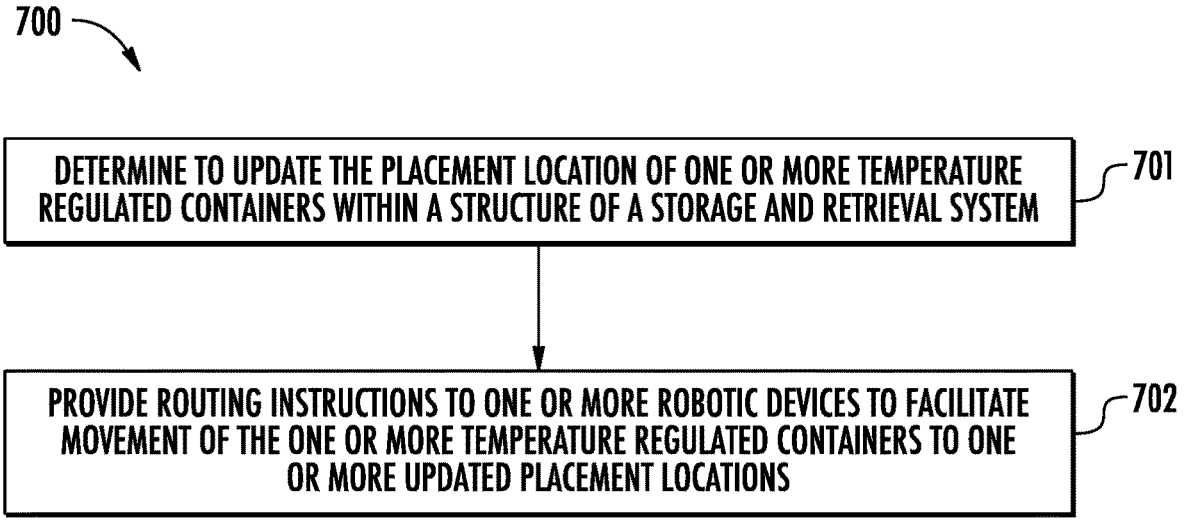
FIG. 7 provides a flowchart diagram of an example process for determining a placement location for one or more temperature regulated containers and/or non-temperature regulated containers in accordance with various aspects and embodiments of the subject disclosure.

FIG. 7 is a flowchart diagram of an example process 700 for determining a placement location for one or more temperature regulated containers 200 within a storage and retrieval system. Via the various steps/operations of the process 700, the placement location of one or more temperature regulated containers 200 may be maintained and/or updated such that the one or more temperature regulated containers 200 are stored within one or more desired environmental attribute ranges.

The process 700 begins at step/operation 701 when the main controller 104 may determine to update the placement location of one or more temperature regulated containers within a structure of the storage and retrieval system 100. In some embodiments, the main controller 104 may determine to update the location of one or more temperature regulated containers in response to a movement trigger event. In some embodiment, a movement trigger event may be determined by the main controller 104 based at least in part on an item demand frequency or temperature regulated container frequency. For example, highly utilized and/or in-demand items and/or associated temperature regulated containers may be moved to a placement location that is more easily accessible and/or closer to a pick station. As another example, items which are not in demand and/or associated temperature regulated containers may be moved to a placement location that is further from a pick station to free up the placement location for more utilized temperature regulated containers.

Figure 8:
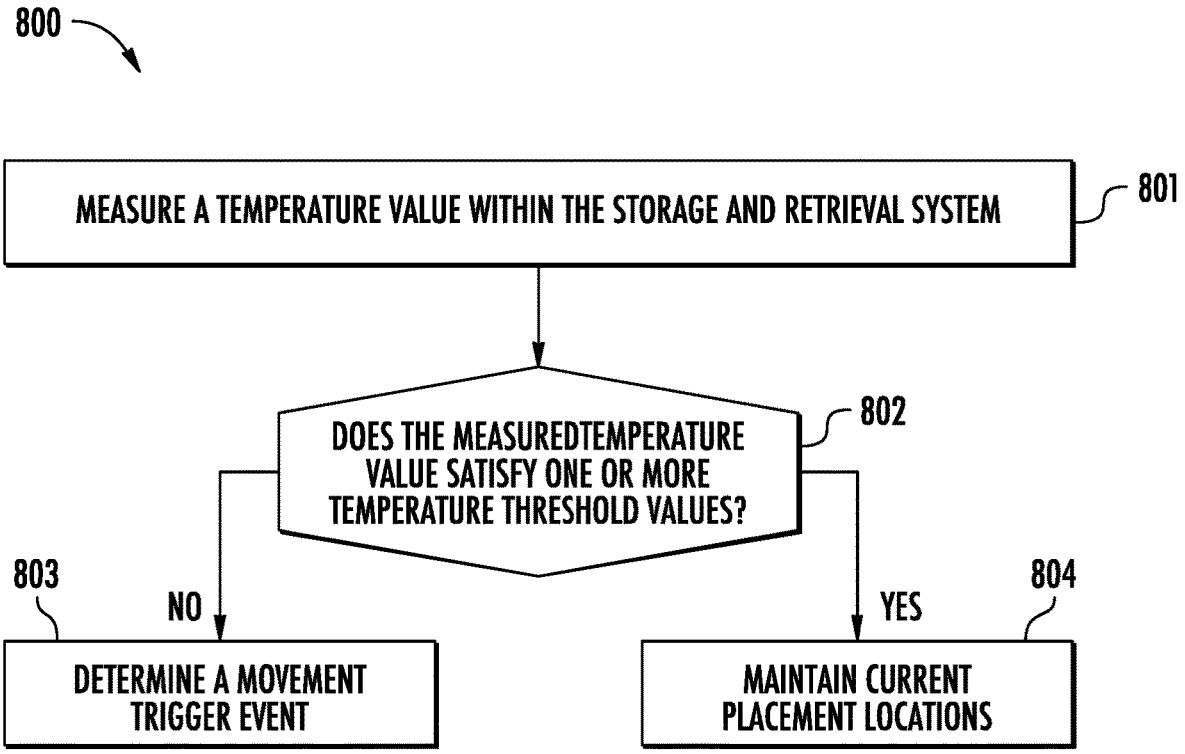
FIG. 8 provides a flowchart diagram of an example process for determining a movement trigger event in accordance with various aspects and embodiments of the subject disclosure.

In some embodiments, the movement trigger may be determined in response to determination that a measured temperature value does not satisfy one or more temperature threshold values. FIG. 8 is a flowchart diagram of an example process 800 for the determining whether a measured temperature value for the storage and retrieval system satisfies one or more temperature threshold values.

At step/operation 801, one or more sensors of the storage and retrieval system may measure a temperature value. In some embodiments, the temperature value corresponds to a particular container subsection of the storage and retrieval system.

At step operation 802, the main controller 104 may determine whether the measured temperature value satisfies one or more temperature threshold values of the storage and retrieval system 100. The one or more temperature threshold values may be based at least in part on the container subsection, the one or more temperature regulated containers stored within the container subsection and/or storage and retrieval system, one or more storage and retrieval system preferences, one or more user preferences, and/or the like. The main controller 104 may receive an indication of the one or more temperature threshold values from one or more user devices. In some embodiments, the one or more sensors may additionally measure one or more other environmental attributes within the storage and retrieval system 100, such as humidity values, and/or the like. In some embodiments, the one or more temperature values and/or environmental attributes may be measured for each container subsection of the storage and retrieval system.

In an instance the temperature value does not satisfy one or more temperature threshold values, flow may proceed to step/operation 803 where the main controller 104 determines a movement trigger event. The main controller 104 may identify the one or more temperature regulated containers within the storage and retrieval system and/or container subsystem which does not satisfy the one or more temperature threshold values and determine to update a placement location for the one or more temperature regulated containers. As such, the temperature regulated containers may be shielded from environment surrounding with an increased temperature, which may reduce the efficiency of the one or more temperature regulated containers.

In some embodiments, the main controller 104 may determine a priority order for the movement of the one or more regulated containers to one or more updated placement locations. In some embodiments, the updated priority order may be based at least in part on the one or more temperature threshold values associated with each temperature regulated container. For example, if a temperature of a container subsystem is determined to be above a threshold temperature value and one or more temperature regulated containers are stored within the container subsystem, the temperature regulated containers associated with the lowest temperature threshold values (e.g., temperature regulated containers associated with freezer items) may be prioritized first. As such, one or more robotic devices 108 may be configured to move the highly prioritized temperature regulated containers before lesser prioritized temperature regulated containers.

In some embodiments, the main controller 104 may determine to update the placement location of one or more temperature regulated containers within the structure of the storage and retrieval system in an instance the one or more measure temperature values for a container subsection and/or storage and retrieval system do not satisfy one or more temperature threshold values. In some embodiments, the one or more temperature regulated containers may be moved from the container subsections and/or out of the particular storage and retrieval system into a different storage and retrieval system and/or associated subsystem, such as a pick station.

In some embodiments, the main controller 104 may additionally determine to activate a cooling system and/or HVAC system associated with the container subsystem and/or storage and retrieval system to return the measured temperature value within an acceptable temperature value range.

In an instance the temperature value satisfies one or more temperature threshold values, flow may proceed to step/operation 804 where the main controller 104 determines to maintain the current configuration of placement locations for the one or more temperature regulated containers.

Returning now to FIG. 7, at step/operation 703, the main controller 104 may provide routing instructions to one or more robotic devices, such as robotic devices 108 to facilitate movement of the one or more temperature regulated containers to one or more updated placement locations. The robotic devices 108 may use the routing instructions to move the one or more temperature regulated containers from one placement location to an update placement location within the storage and retrieval system.

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the claims below.

That which is claimed is:

1. A temperature regulated apparatus comprising:

a base container, wherein the base container includes at least:

a base portion;

one or more sidewall portions, wherein the one or more sidewall portions are integrated with an interior surface of the base portion;

a lid portion, wherein the lid portion is configured to attach to the one or more sidewall portions, and wherein the base container defines an interior portion defined by at least the base portion, the one or more sidewall portions, and the lid portion;

one or more thermoelectric components, wherein (i) each of the one or more thermoelectric components is configured to be disposed within the interior portion of the base container, (ii) each thermoelectric component comprises an exterior surface, an interior surface, and a composite semiconductor layer disposed between the exterior surface and the interior surface, and (iii) each thermoelectric component is configured to, when a current flows through the thermoelectric component, transfer heat between the interior surface and the exterior surface; and an inductive charging grid, wherein the inductive charging grid is integrated within the base container, wherein the inductive charging grid is configured to induce the current within the one or more thermoelectric components, wherein the inductive charging grid comprises one or more inductive charging grid sections, wherein each inductive charging grid section is configured to provide the current to the one or more thermoelectric components within a portion of the base container.

2. The temperature regulated apparatus of claim 1, wherein the inductive charging grid is configured to be powered using one or more batteries.

3. The temperature regulated apparatus of claim 1, wherein the temperature regulated apparatus further comprises:

one or more sensors, wherein the one or more sensors may be configured to measure at least one of a temperature or humidity of the interior portion of the base container.

4. The temperature regulated apparatus of claim 1, wherein:

the base container further includes one or more louvre sets, wherein:

each louvre set includes one or more louvres configured to actuate as a unit, each louvre set is configured to move between an open configuration and a closed configuration, when a louvre set is not in the closed configuration, air may flow between the interior portion of the base container and a surrounding external environment of the base container.

5. The temperature regulated apparatus of claim 1, wherein the temperature regulated apparatus further comprises:

a controller, wherein the controller is configured to perform one or more operational tasks and wherein the controller is in communication with at least one or more sensors and the inductive charging grid.

6. The temperature regulated apparatus of claim 5, wherein the one or more operational tasks include at least one of:

actuating one or more louvre sets between one or more configurations, activating the one or more inductive charging grid sections of the inductive charging grid, or providing one or more warning data objects to one or more user devices when one or more trigger events occur.

7. The temperature regulated apparatus of claim 6, wherein the one or more trigger events include determination that one or more temperature values do not satisfy one or more temperature threshold values, one or more humidity values do not satisfy one or more humidity threshold values, or a maintenance time duration satisfies one or more maintenance time durations.

8. The temperature regulated apparatus of claim 1, wherein two or more of the one or more thermoelectric components are stacked adjacent to one or another such that the interior surface of one thermoelectric component is adjacent to the exterior surface of another thermoelectric component.

9. A method comprising:

measuring, using one or more sensors, a temperature value within a temperature regulated container;

determining whether the measured temperature value satisfies one or more temperature threshold values; and in response to determining that the measured temperature value does not satisfy the one or more temperature threshold values, activating one or more inductive charging grid sections of an inductive charging grid.

10. The method of claim 9, the method further comprising:

measuring, using the one or more sensors, a temperature value within the temperature regulated container after a duration of time since activation of the one or more inductive charging grid sections;

determining whether the measured temperature value satisfies the one or more temperature threshold values;

in response to determining that the measured temperature value does not satisfy the one or more temperature threshold values, maintaining activation of the one or more inductive charging grid sections of the inductive charging grid; and in response to determining that the measured temperature value satisfies the one or more temperature threshold values, deactivating the one or more inductive charging grid sections of the inductive charging grid.

11. The method of claim 9, the method further comprising:

in response to determining that the measured temperature value does not satisfy the one or more temperature threshold values, actuating one or more louvre sets between one or more configurations.

12. The method of claim 9, the method further comprising:

measuring, using the one or more sensors, a humidity value within the temperature regulated container;

determining whether the measured humidity value satisfies one or more humidity threshold values;

in response to determining that the measured humidity value does not satisfy the one or more humidity threshold values, actuating one or more louvre sets between one or more configurations.

13. The method of claim 9, the method further comprising:

providing one or more warning data objects to one or more user devices when one or more trigger events occur.

14. The method of claim 13, wherein the one or more trigger events include determination that one or more temperature values do not satisfy the one or more temperature threshold values, one or more humidity values do not satisfy one or more humidity threshold values, or a maintenance time duration satisfies one or more maintenance time durations.

15. A computer program product comprising at least one non-transitory computer-readable storage medium having computer executable program code instructions therein, the computer executable program code instructions comprising program code instructions configured, upon execution, to:

measure a temperature value within a temperature regulated container;

determine whether the measured temperature value satisfies one or more temperature threshold values; and when the measured temperature value does not satisfy the one or more temperature threshold values, activate one or more inductive charging grid sections of an inductive charging grid.

16. The computer program product of claim 15, the computer executable program code instructions comprising the program code instructions further configured, upon execution, to:

measure a temperature value within the temperature regulated container after a duration of time since activation of the one or more inductive charging grid sections;

determine whether the measured temperature value satisfies the one or more temperature threshold values;

when the measured temperature value does not satisfy the one or more temperature threshold values, maintain activation of the one or more inductive charging grid sections of the inductive charging grid; and when the measured temperature value satisfies the one or more temperature threshold values, deactivate the one or more inductive charging grid sections of the inductive charging grid.

17. The computer program product of claim 15, the computer executable program code instructions comprising the program code instructions further configured, upon execution, to:

when the measured temperature value does not satisfy the one or more temperature threshold values, actuate one or more louvre sets between one or more configurations.

* * * * *